US011986090B2

(12) United States Patent
Flagin et al.

(10) Patent No.: US 11,986,090 B2
(45) Date of Patent: May 21, 2024

(54) TELESCOPING SLIDE SYSTEM WITH A TOOLLESS RELEASE FEATURE

(71) Applicant: General Devices Co., INC., Indianapolis, IN (US)

(72) Inventors: Don Flagin, Greenfield, IN (US); Elizabeth Kokinos, Fishers, IN (US)

(73) Assignee: General Devices Co., INC., Indianapolis, IN (US)

( * ) Notice: Subject to any disclaimer, the term of this patent is extended or adjusted under 35 U.S.C. 154(b) by 0 days.

(21) Appl. No.: 17/992,886

(22) Filed: Nov. 22, 2022

(65) Prior Publication Data

US 2023/0157451 A1 May 25, 2023

Related U.S. Application Data

(60) Provisional application No. 63/282,383, filed on Nov. 23, 2021.

(51) Int. Cl.

*A47B 88/57* (2017.01)
*A47B 88/407* (2017.01)
*A47B 88/423* (2017.01)

(52) U.S. Cl.

CPC ..... *A47B 88/57* (2017.01); *A47B 88/407* (2017.01); *A47B 2088/4235* (2017.01); *A47B 2210/0081* (2013.01)

(58) Field of Classification Search

CPC . A47B 88/407; A47B 88/0407; A47B 88/423; A47B 88/0418; A47B 88/427; A47B 88/0422; A47B 88/44; A47B 88/443; A47B 88/473; A47B 88/477; A47B 88/57; A47B 88/16; A47B 2088/4235; A47B 2088/0444; A47B 2210/0016; A47B 2210/0018; A47B 2210/0081

See application file for complete search history.

(56) References Cited

U.S. PATENT DOCUMENTS 3,650,578 A 3/1972 Vecchio et al.
3,995,927 A * 12/1976 Stein ..... A47B 88/57 384/19

(Continued)

FOREIGN PATENT DOCUMENTS

CN 107095493 A * 8/2017
EP 1522235 A1 * 4/2005 ..... A47B 88/14

OTHER PUBLICATIONS

PCT International Search Report and Written Opinion for Application No. PCT/US2022/080324, dated Feb. 15, 2023, 16 pages.

*Primary Examiner* — Andrew M Roersma
(74) *Attorney, Agent, or Firm* — Barnes & Thornburg LLP

(57) ABSTRACT

A telescoping slide system comprising a left-side telescoping slide assembly and a right-side telescoping slide assembly that each include interconnected slide members moveable to extend and retract among a retracted-storage stage and an extended-service stage. Each telescoping slide assembly includes a stationary slide member, a intermediate slide member that moves relative to the stationary slide member in a channel formed in the stationary slide member, and a load-carrying slide member that moves relative to the stationary slide member and the intermediate slide member in a channel formed in the intermediate slide member.

20 Claims, 16 Drawing Sheets

(56) References Cited

U.S. PATENT DOCUMENTS 4,560,212 A * 12/1985 Papp ..... A47B 88/493 312/334.47
4,749,242 A 6/1988 Rechberg
5,085,523 A 2/1992 Hobbs
5,169,221 A 12/1992 Wheeler
5,275,064 A 1/1994 Hobbs
5,385,405 A 1/1995 Hobbs et al.
5,405,195 A 4/1995 Hobbs
5,417,490 A * 5/1995 Hobbs ..... A47B 88/42 312/334.32
5,417,496 A 5/1995 Hobbs
5,484,197 A * 1/1996 Hansen ..... A47B 88/493 384/19
5,961,193 A 10/1999 Hobbs
6,209,979 B1 4/2001 Fall et al.
6,601,933 B1 8/2003 Greenwald
6,749,275 B2 6/2004 Cutler et al.
6,871,920 B2 3/2005 Greenwald et al.
6,926,378 B2 8/2005 Greenwald et al.
6,929,339 B1 8/2005 Greenwald et al.
6,935,711 B1 8/2005 Naue et al.
6,957,878 B2 10/2005 Greenwald et al.
7,111,913 B2 9/2006 Dubon
7,210,752 B2 5/2007 Dubon
7,571,968 B2 8/2009 Ji et al.
7,604,307 B2 10/2009 Greenwald et al.
8,851,587 B2 * 10/2014 Brock ..... F16C 29/045 312/334.39
8,888,201 B2 11/2014 Chen et al.
2008/0158845 A1 7/2008 Wen et al.
2012/0043872 A1 * 2/2012 Enos ..... A47B 88/493 312/332.1
2013/0058599 A1 3/2013 Brock et al.
2013/0328470 A1 * 12/2013 Yoshizumi ..... A47B 88/57 312/334.47

* cited by examiner

TELESCOPING SLIDE SYSTEM WITH A TOOLLESS RELEASE FEATURE

PRIORITY CLAIM

This application claims priority under 35 U.S.C. § 119(e) to U.S. Provisional Application Ser. No. 63/282,383 filed Nov. 23, 2021, which is expressly incorporated by reference herein.

BACKGROUND

The present invention relates to telescoping slide systems for moving equipment between a fully retracted position and an extended position, and particularly to a slide assembly having at least three slide members and lock mechanisms for locking the slide members in various retracted and extended positions. More particularly, the present invention relates to a telescoping slide assembly that contains mechanisms for controlling unlocking of the slide members during telescoping movement of the slide members between extended and retracted positions.

A conventional telescoping slide assembly typically includes a stationary slide member, a load-carrying slide member, and an intermediate slide member. The intermediate slide member is positioned and configured to move the load-carrying slide member toward and away from the stationary slide member. Typically, a pair of telescoping slide assemblies are positioned in side-by-side spaced-apart parallel relation so that either a load-carrying platform or one or more pieces of equipment can be carried on the two side-by-side load-carrying slide members. It is also common to use a pair of telescoping slide assemblies to support a cabinet drawer between a retracted position inside the cabinet and an extended position outside the cabinet.

The stationary slide member is typically mounted to a fixed frame to anchor the slide assembly. The frame could be a cabinet, a truck bed, or any other suitable platform. For example, it is known to use telescoping slide assemblies to slide heavy pieces of equipment into and out of a truck bed.

Various kinds of equipment or loads can be anchored to the movable load-carrying slide members so that such loads can be moved easily relative to the truck bed or the like during telescoping extension and retraction of the intermediate and load-carrying slide members in each slide assembly relative to the stationary slide members that are anchored to the truck bed. Typically, a telescoping slide assembly is extended and retracted manually by an operator and thus must be capable of moving heavy loads easily and quickly under the control of an operator during loading of equipment onto the truck and unloading of equipment from the truck.

Locking interconnections between each of the three slide members may be provided to prevent extension or retraction of the slide members relative to each other. This allows a drawer or equipment rack mounted on a pair of telescoping slide assemblies to be extended outward in the extending direction and locked to maintain a desired extended position.

Typically, as the telescoping slide assemblies extend to move the equipment or load from the retracted position, the slide members lock automatically in an extended position to maintain the telescoping slide system in the extended position. An operator initiates the extension process by actuating a release mechanism to allow the slide members to extend relative to one another. When the intermediate slide member reaches its fully extended position, the load-carrying slide member automatically locks to the intermediate slide member and thereby stops the slide assembly in the extended position.

In some instances, the equipment may need to be separated from the fixed frame to be moved to another location. In many applications, an operator manually detaches the equipment using tools to remove fasteners coupling the equipment to the load-carrying slide members. In other applications, the load-carrying slide members may be coupled to the intermediate slide members to prevent the load-carrying slide member from moving out of a channel formed in the intermediate slide members. Similarly, an operator has to manually detach the load-carrying slide members from the intermediate slide members using tools to remove fasteners coupling the load-carrying slide members to the intermediate slide members. The manual removal of the fasteners makes separating the equipment from the fixed frame difficult.

SUMMARY

A telescoping slide system in accordance with the present disclosure includes a left-side telescoping slide assembly and a right-telescoping slide assembly. Both telescoping slide assemblies include interconnected slide members moveable to extend and retract among a RETRACTED-STORAGE stage, an EXTENDED-SERVICE stage, a PRE-REMOVAL stage, and a REMOVAL stage.

In illustrative embodiments, the telescoping slide system further includes a toolless release feature coupled to the left-side and the right-side telescoping slide assemblies for controlling movement of the telescoping slide assemblies between the RETRACTED-STORAGE, EXTENDED-SERVICE, PRE-REMOVAL, and REMOVAL stages. The toolless release feature enables a technician to remove a piece of equipment mounted to load-carrying slide members of each telescoping slide assembly from a storage rack without the use of any tools In illustrative embodiments, both the left-side and the right-side telescoping slide assemblies include a stationary slide member, an intermediate slide member, and a load-carrying slide member. The intermediate slide member moves relative to the stationary slide member in a channel formed in the stationary slide member. The load-carrying slide member that moves relative to the stationary slide member and the intermediate slide member in a channel formed in the intermediate slide member.

In illustrative embodiments, the toolless release feature includes a left-side locking lever and a right-side locking lever. The left-side locking lever is pivotably coupled to the load-carrying slide member of the left-side telescoping assembly, while the right-side locking lever pivotably is coupled to the load-carrying slide member of the right-side telescoping slide assembly. The left-side locking lever and the right-side locking lever are each configured to pivot selectively relative to the corresponding load-carrying slide member to lock or release the load-carrying members between the RETRACTED-STORAGE stage, the EXTENDED-SERVICE stage, PRE-REMOVAL stage, and the REMOVAL stage.

Additional features of the present disclosure will become apparent to those skilled in the art in response to consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a telescoping slide system in accordance with the present disclosure comprising left-side and right-side telescoping slide assemblies movable to extend and retract among a RETRACTED-STORAGE stage as shown in FIG. 6, an EXTENDED-SERVICE stage as shown in FIG. 7, a PRE-REMOVAL stage as shown in FIG. 8, and a REMOVAL stage as shown in FIG. 9 and further showing a toolless release feature for controlling movement of the telescoping slide assemblies between the RETRACTED-STORAGE, EXTENDED-SERVICE, PRE-REMOVAL, and REMOVAL stages to enable a technician to remove a piece of equipment mounted to load-carrying slide members of each telescoping slide assembly from a storage rack without the use of any tools;

FIG. 1A is an enlarged perspective view of the telescoping slide system of FIG. 1 showing the toolless release feature includes a left-side locking lever pivotably coupled to the load-carrying slide member of the left-side telescoping assembly and a right-side locking lever pivotably coupled to the load-carrying slide member of the right-side telescoping slide assembly, and showing how the left-side locking lever and the right-side locking lever are each configured to pivot selectively relative to the corresponding load-carrying slide member to lock or release the load-carrying members between the RETRACTED-STORAGE stage, the EXTENDED-SERVICE stage, PRE-REMOVAL stage, and the REMOVAL stage;

FIG. 2 is a perspective view of the telescoping slide system of FIG. 1 showing the telescoping slide system has moved from the RETRACTED-STORAGE stage to the EXTENDED-SERVICE stage by changing the left-side locking lever of the toolless release feature from a STORAGE-ENGAGED position as shown in FIG. 6L to a SERVICE-ENGAGED position as shown in FIG. 7L so that the piece of equipment is moved out of the storage rack and the intermediate and load-carrying members of each telescoping slide assembly are blocked from movement relative to the stationary slide members coupled to the storage rack to allow the technician to safely access the piece of equipment;

FIG. 3 is a perspective view similar to FIG. 2 showing the telescoping slide system has moved from the EXTENDED-SERVICE stage to a PRE-REMOVAL stage in an attempt to begin removing the piece of equipment from the storage rack, and showing the telescoping slide system has moved from the EXTENDED-SERVICE stage to the PRE-REMOVAL stage by changing the left-side locking lever of the toolless release feature from the SERVICE-ENGAGED position to a PRE-REMOVAL-RELEASED position as shown in FIG. 8L to allow the telescoping slide system to move toward the REMOVAL stage which causes the right-side locking lever of the toolless release feature to change from a SERVICE-UNRESTRICTED position as shown in FIG. 7R to a PRE-REMOVAL-ENGAGED position as shown in FIG. 8R to block immediate removal of the load-carrying members of each telescoping slide assembly from the intermediate and stationary slide members, thereby preventing any accidental removal of the equipment from the storage rack;

FIG. 4 is a perspective view similar to FIG. 3 showing the telescoping slide system has moved from the PRE-REMOVAL stage to a REMOVAL stage to finish removing the piece of equipment from the storage rack, and showing the telescoping slide system has moved from the PRE-REMOVAL stage to the REMOVAL stage by changing the right-side locking lever of the toolless release feature from the PRE-REMOVAL-ENGAGED position to the RELEASED position as shown in FIG. 9R so that the load-carrying members of each telescoping slide assembly are removed from the intermediate and stationary slide members, thereby allowing the piece of equipment to be fully separated from the storage rack;

FIG. 5 is an exploded view of the telescoping slide system of FIG. 1 showing the left-side locking lever of the toolless release feature is configured to be coupled to the load-carrying slide member of the left-side telescoping slide assembly and the right-side locking lever of the toolless release feature is configured to be coupled to the load-carrying slide member of the right-side telescoping slide assembly, and showing the stationary and intermediate carriers include locking apertures that are configured to be engaged by the left and right-side locking levers at each of the corresponding stages;

FIG. 6 is a perspective view of the telescoping slide system of FIG. 1 showing the telescoping slide system in the RETRACTED-STORAGE stage with portions of the storage rack and the telescoping slide assemblies broken away to show the left-side locking lever of the toolless release feature in the STORAGE-ENGAGED position and the right-side locking lever of the toolless release feature in the STORAGE-UNRESTRICTED position;

FIG. 6L is a detail view of FIG. 6 showing the left-side locking lever of the toolless release feature in the STORAGE-ENGAGED position in which a locker head formed on the left-side locking lever extends into a first set of locking apertures formed in the intermediate and stationary slide members on the left-side telescoping slide assembly, thereby locking the telescoping slide system in the RETRACTED-STORAGE stage;

FIG. 6R is a detail view of FIG. 6 showing the right-side locking lever of the toolless release feature in the STORAGE-UNRESTRICTED position in which a locker head formed on the right-side locking lever abuts an inner surface of the stationary slide member and does not block the load-carrying and intermediate slide members of the right-telescoping slide assembly from moving relative to the stationary slide member so that when the left-side locking lever is released the telescoping slide system is free to move between the RETRACTED-STORAGE stage and the EXTENDED-SERVICE stage;

Figure 7:
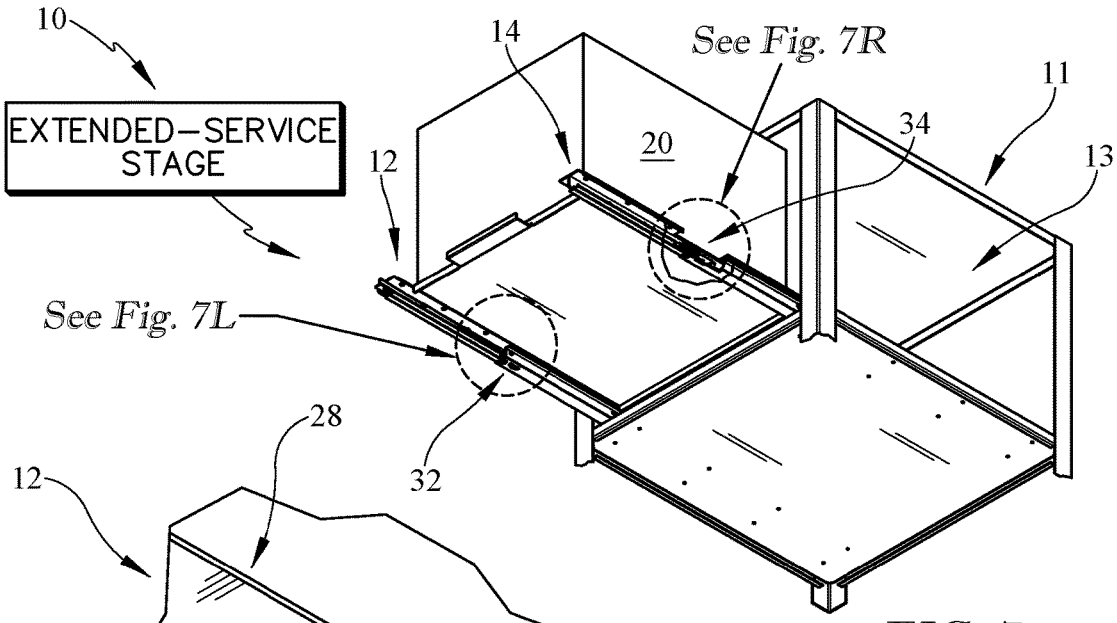
FIG. 7 is a perspective view similar to FIG. 6 showing the telescoping slide system in the EXTENDED-SERVICE stage with portions of the telescoping slide assemblies broken away to show the left-side locking lever of the toolless release feature in the SERVICE-ENGAGED position and the right-side locking lever of the toolless release feature in the SERVICE-UNRESTRICTED position.
Figure 7L:
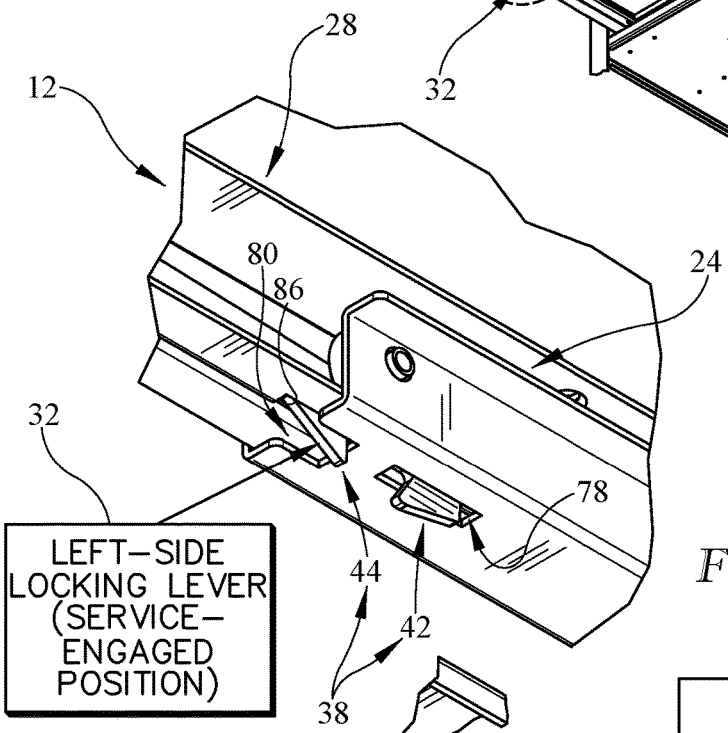
FIG. 7L is a detail view of FIG. 7 showing the left-side locking lever of the toolless release feature in the SERVICE-ENGAGED position in which the locker head of the left-side locking lever extends into a second set of locking apertures formed in the intermediate slide member of the left-side telescoping slide assembly, thereby locking the telescoping slide system in the EXTENDED-SERVICE stage.
Figure 7R:
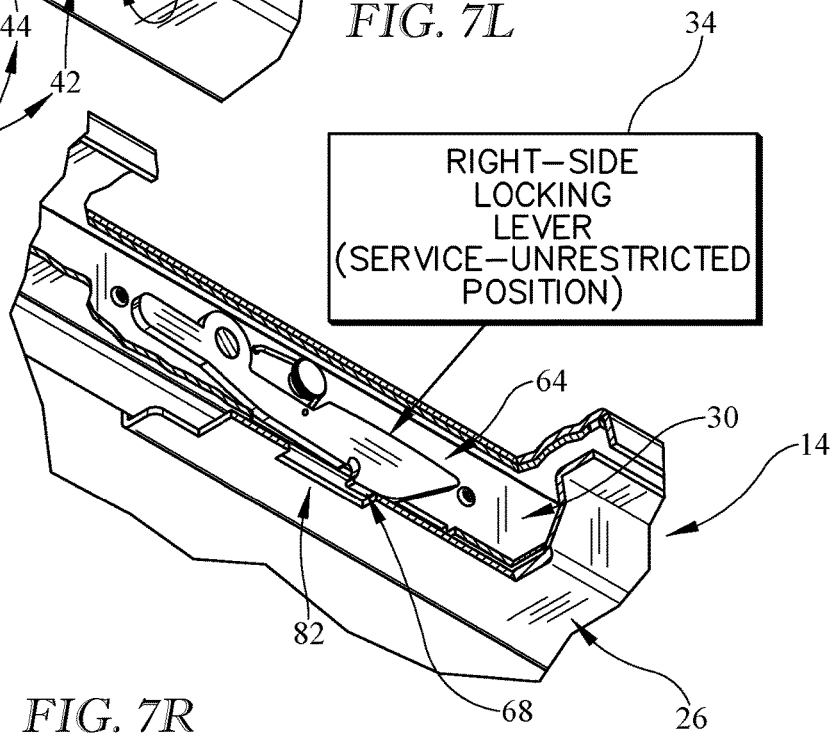
Figure 8:
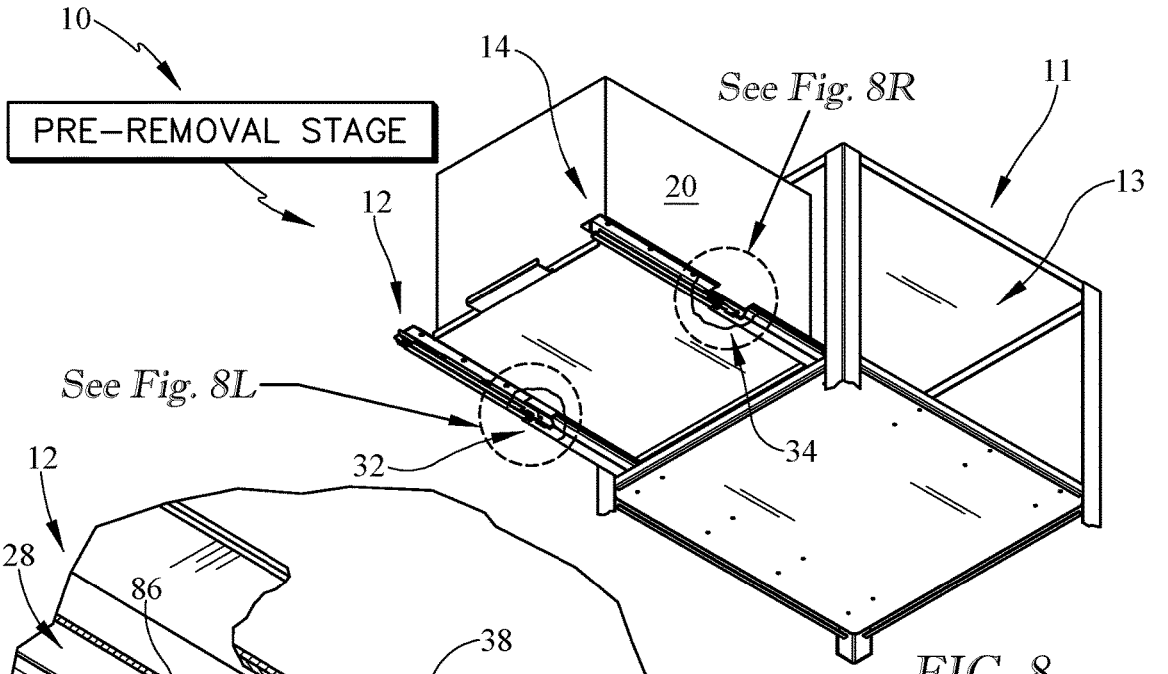
Figure 8L:
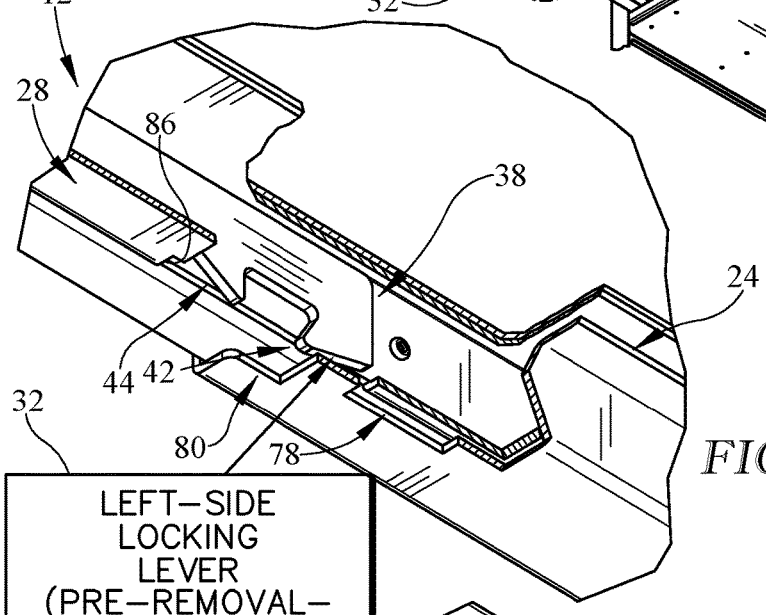
Figure 8R:
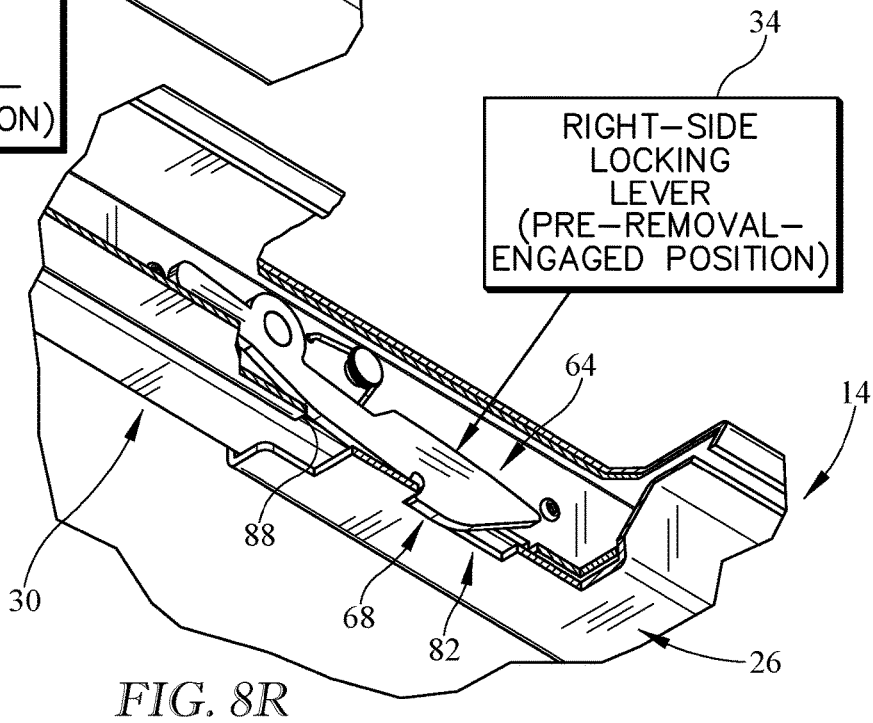
Figure 9:
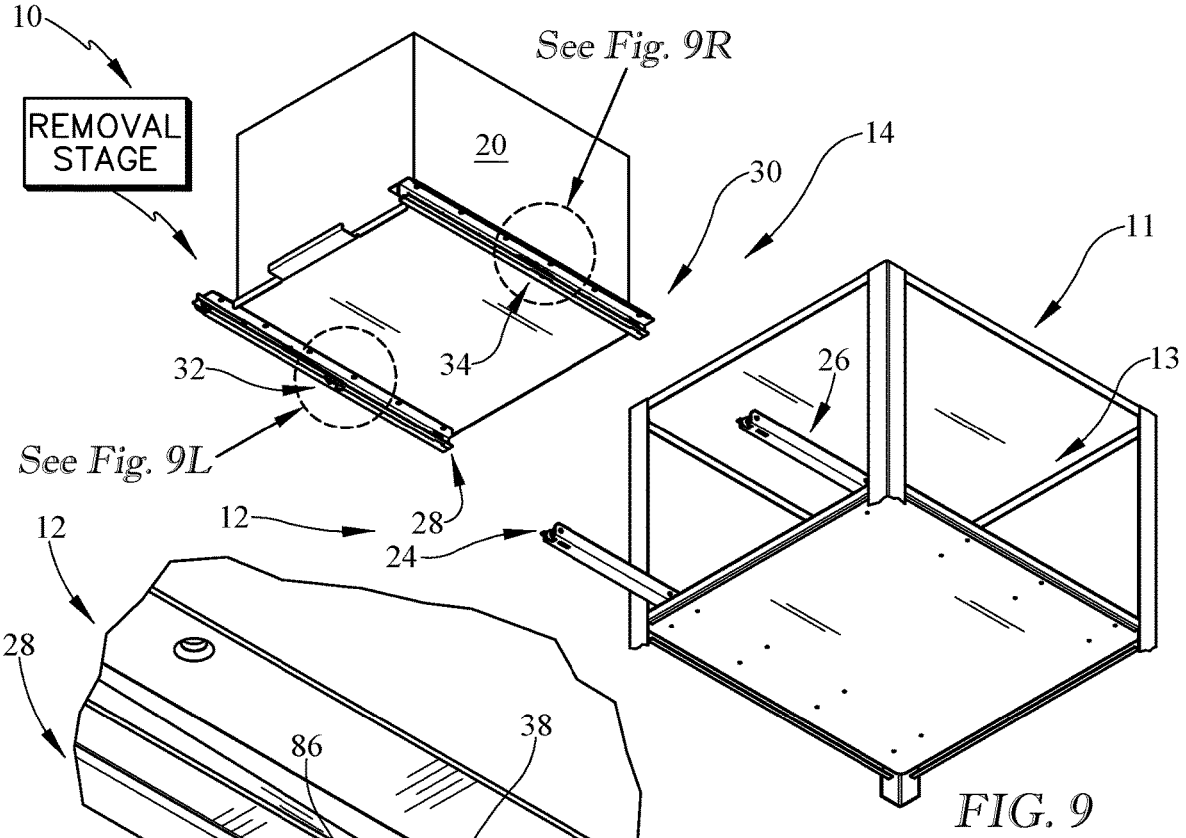
Figure 9L:
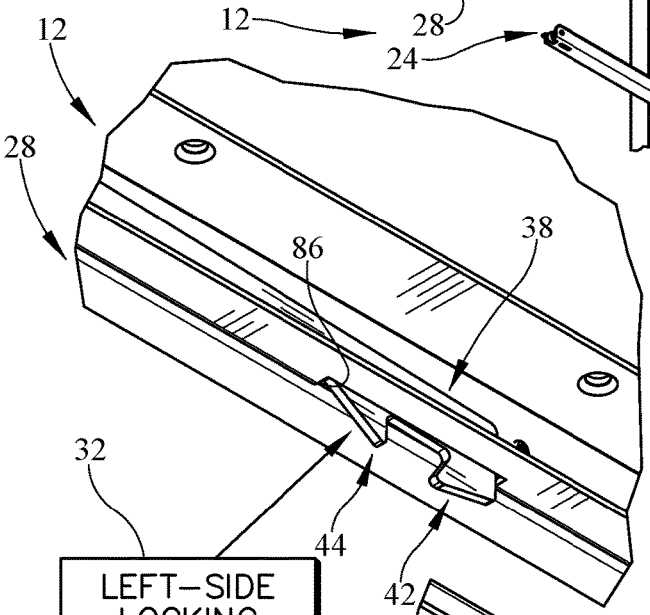
Figure 9R:
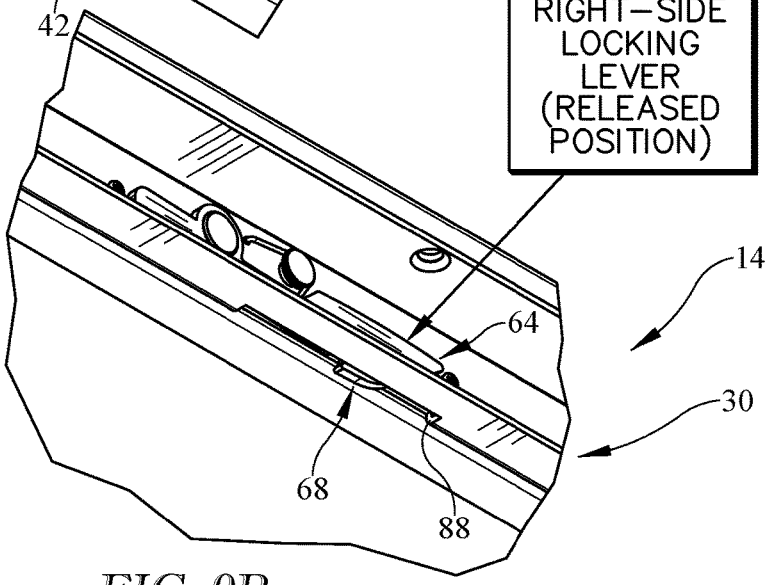
Figures 10, 11:
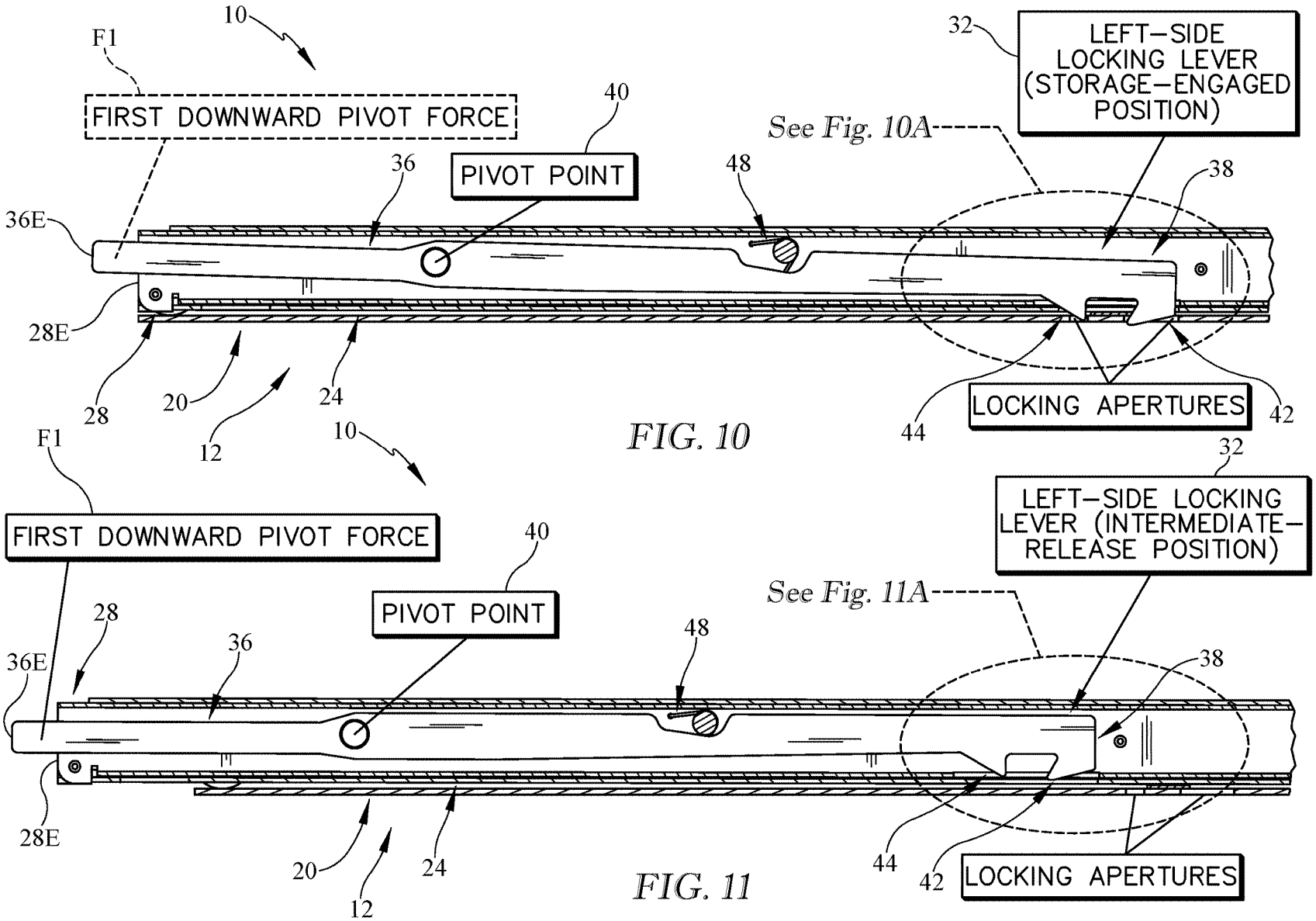
Figures 10A, 11A:
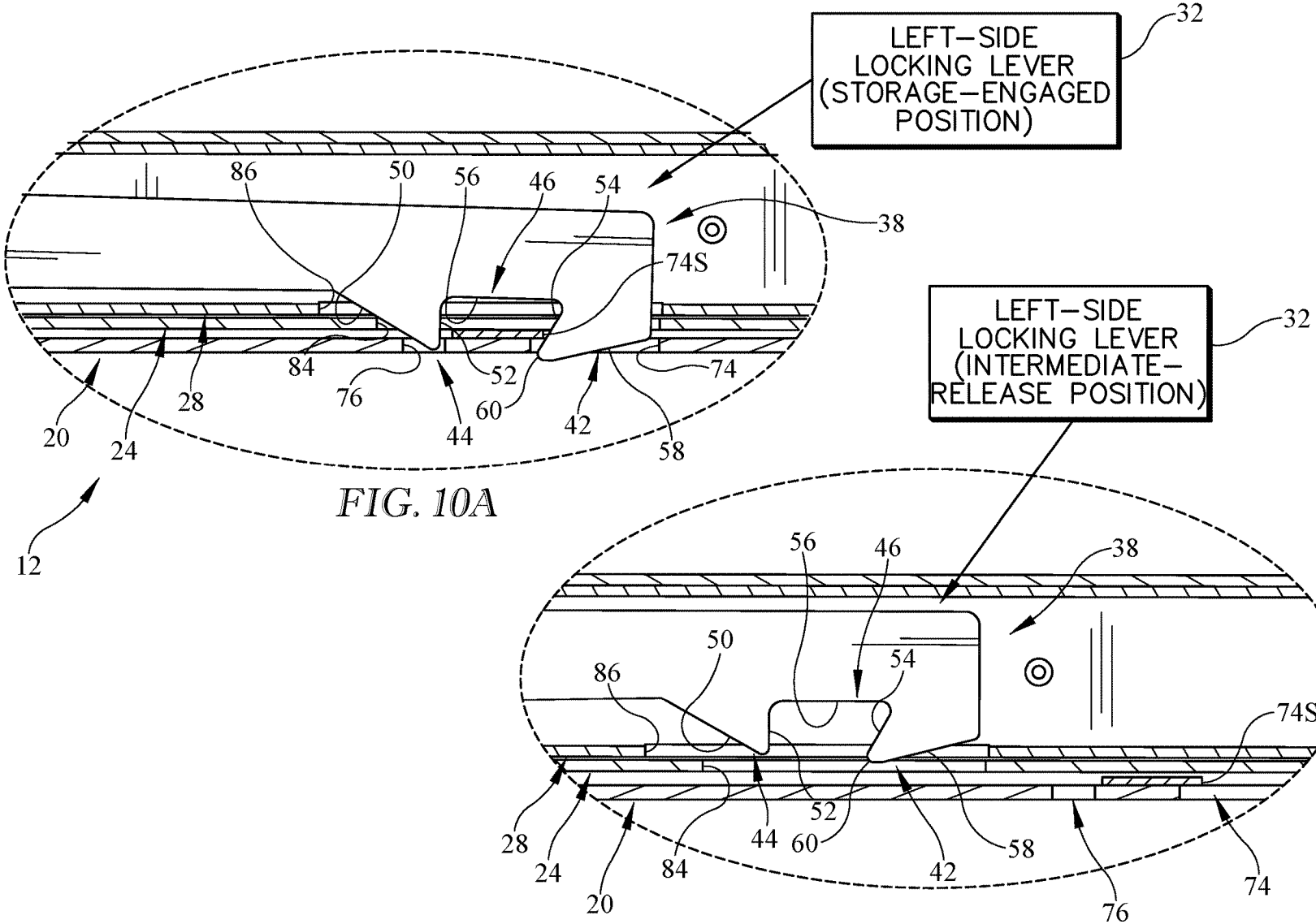
Figure 12:
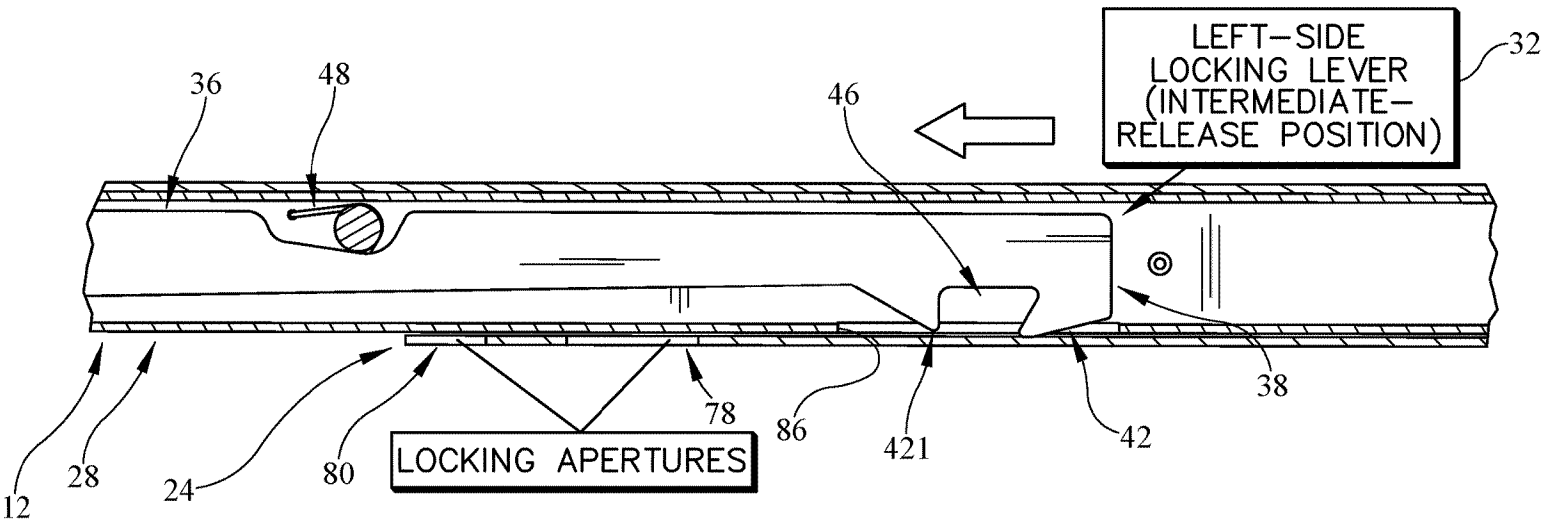
Figure 13:
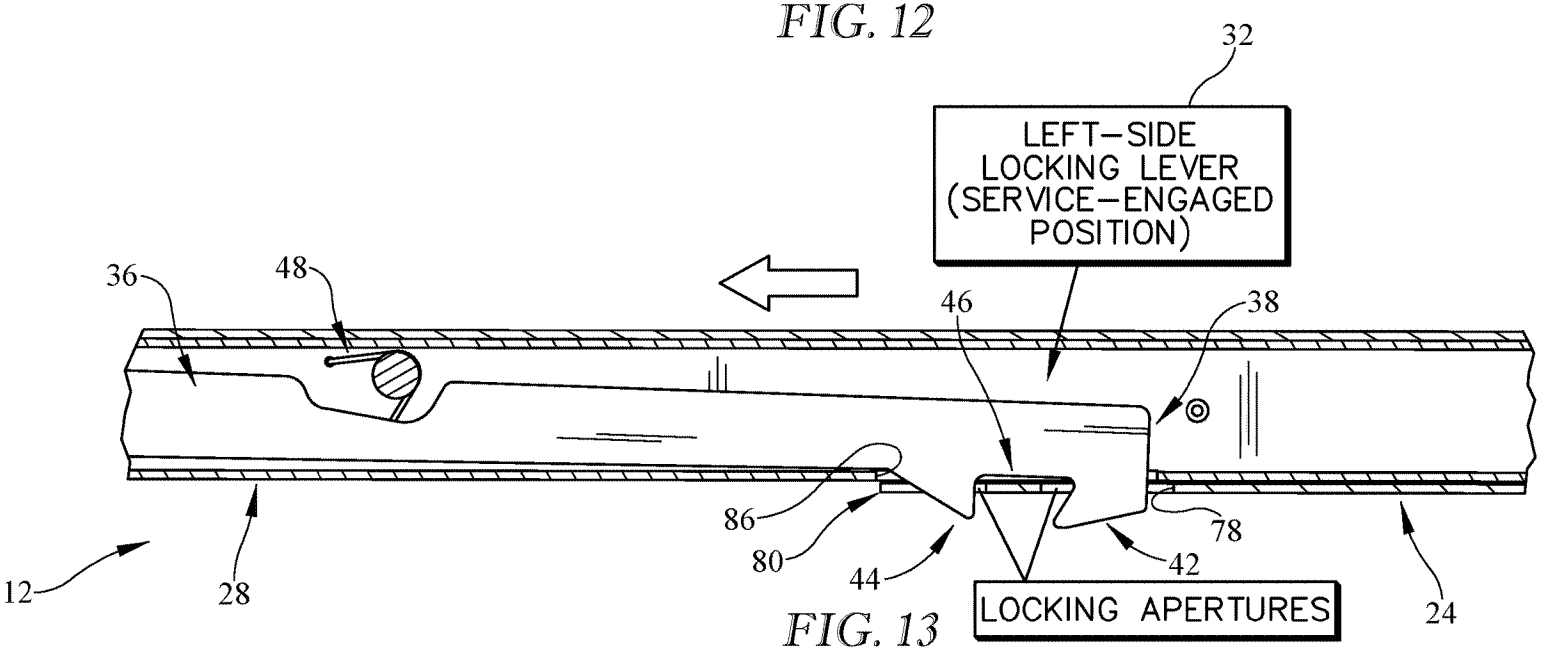
Figure 14:
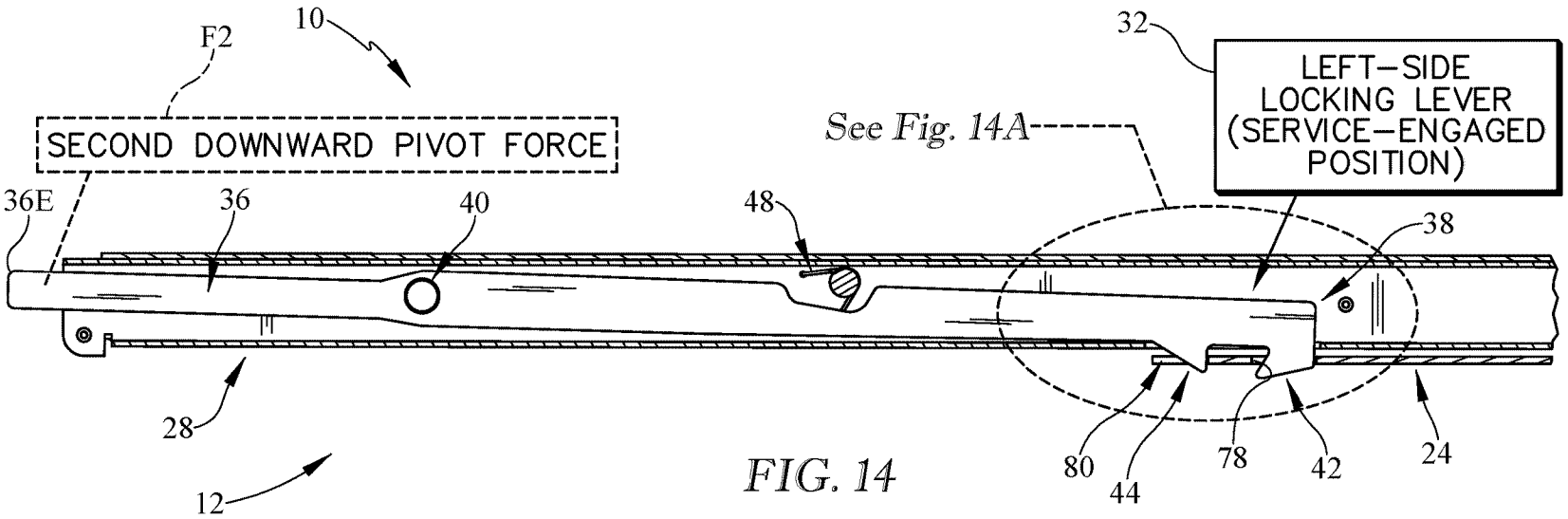
Figure 15:
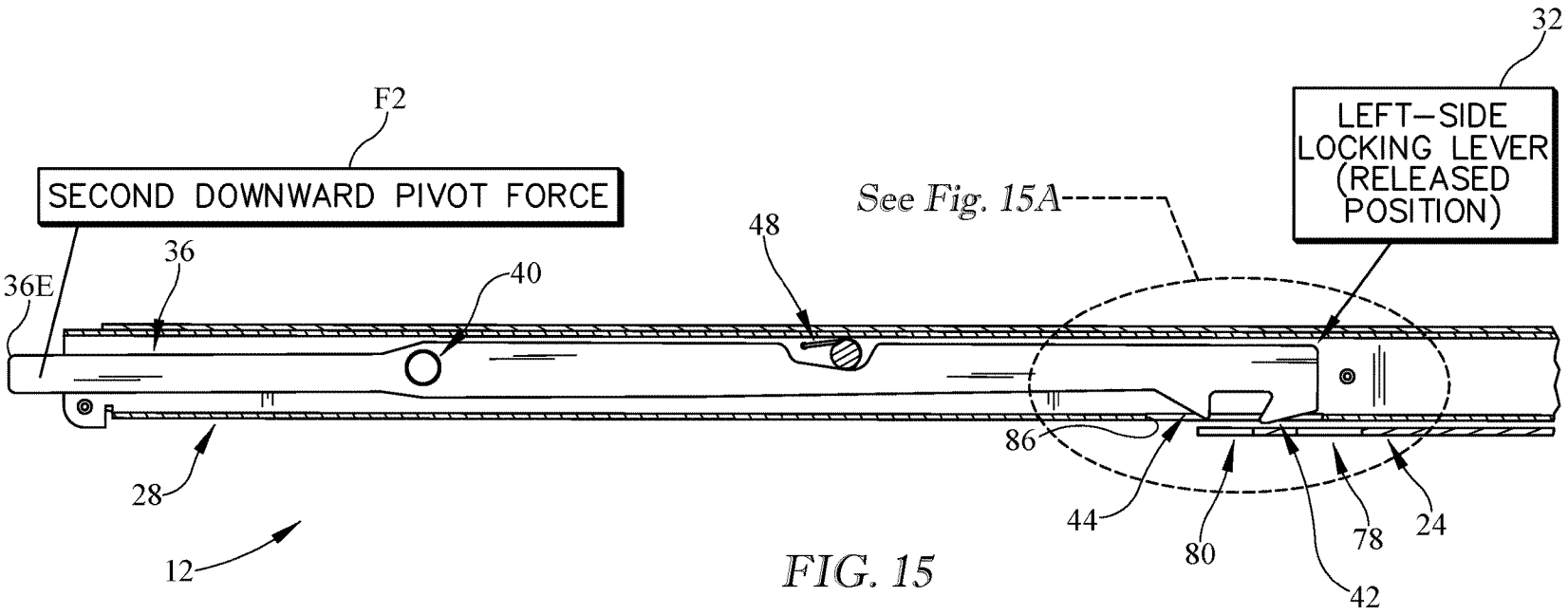
Figures 14A, 15A:
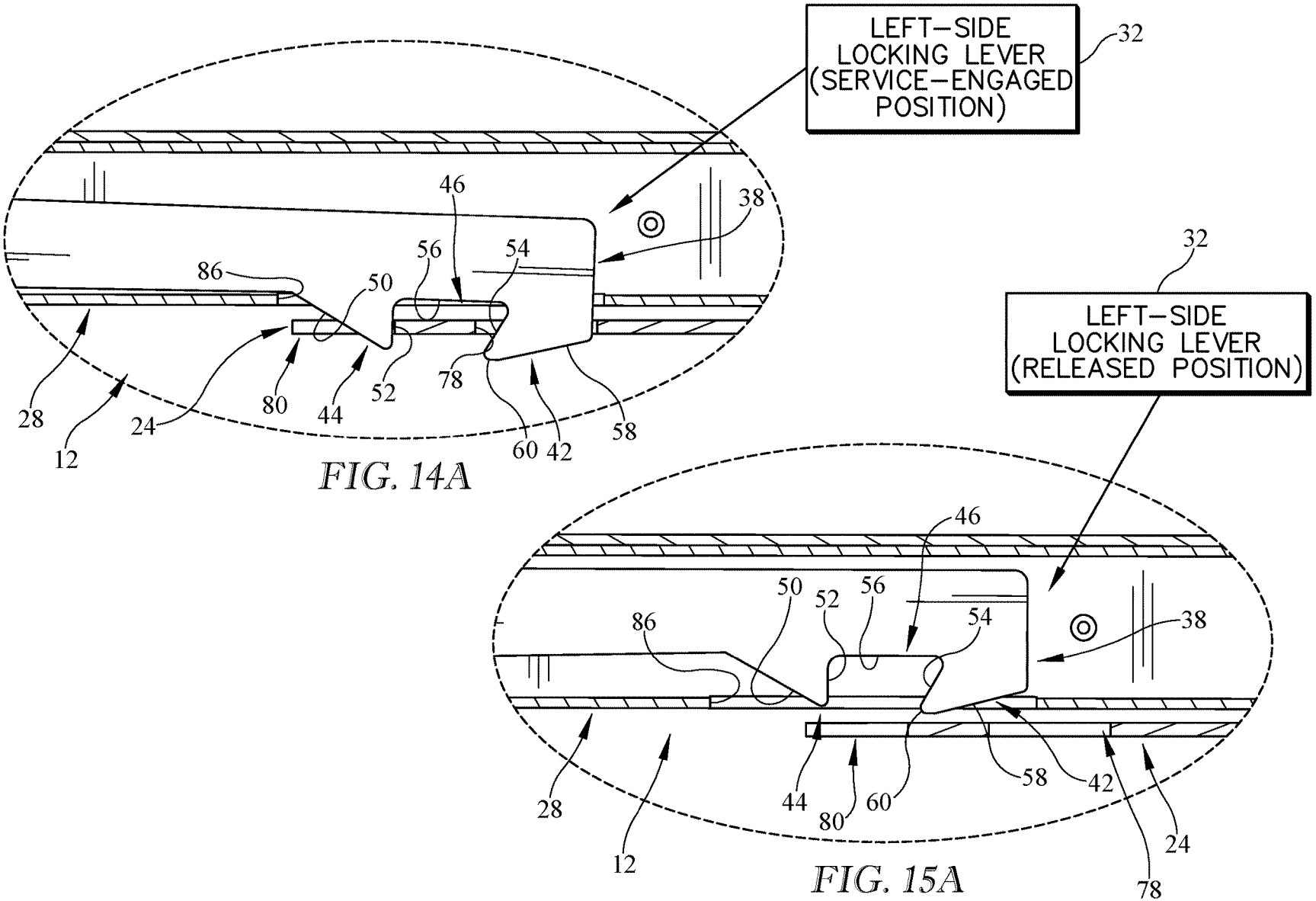
Figure 16:
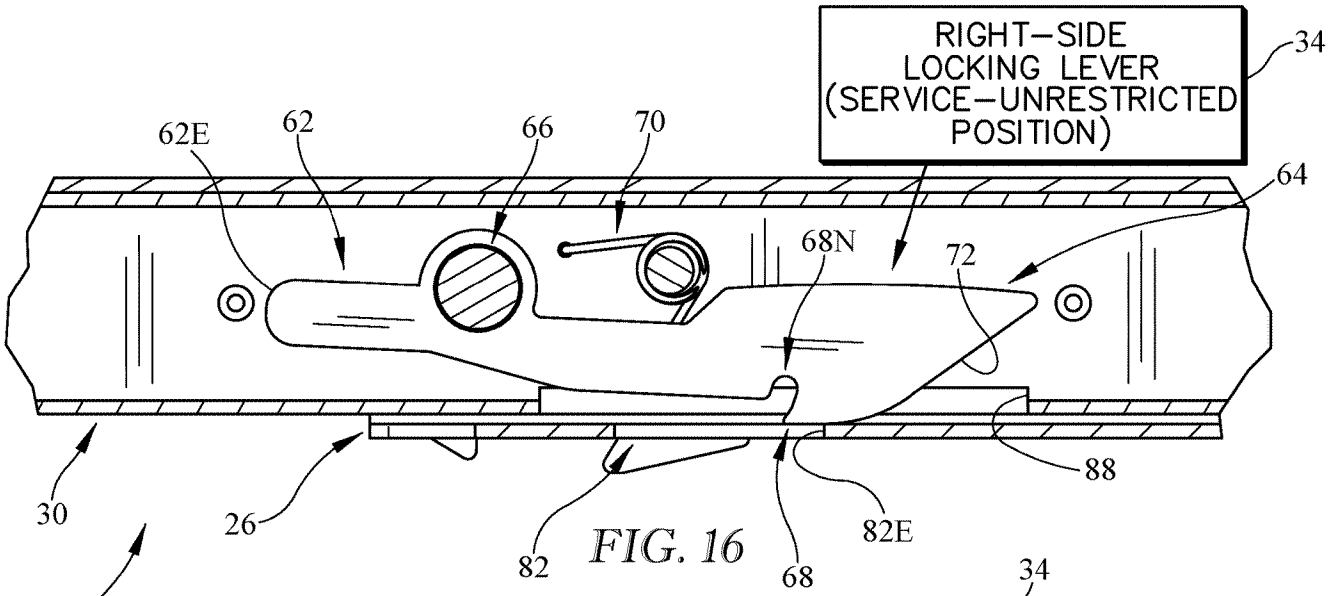
Figure 17:
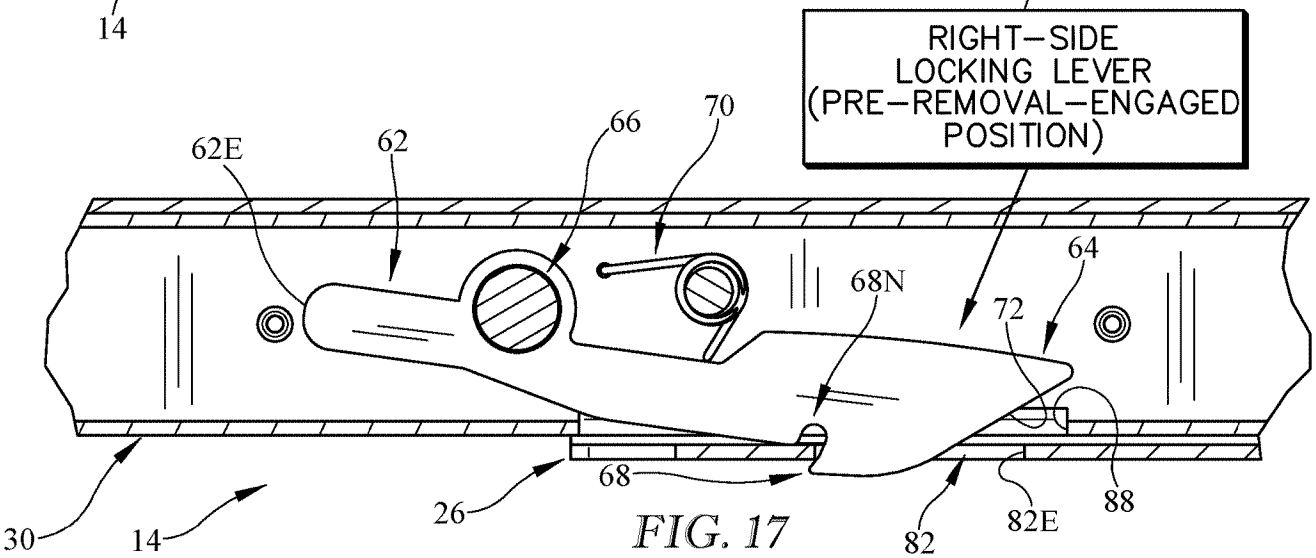
Figure 18:
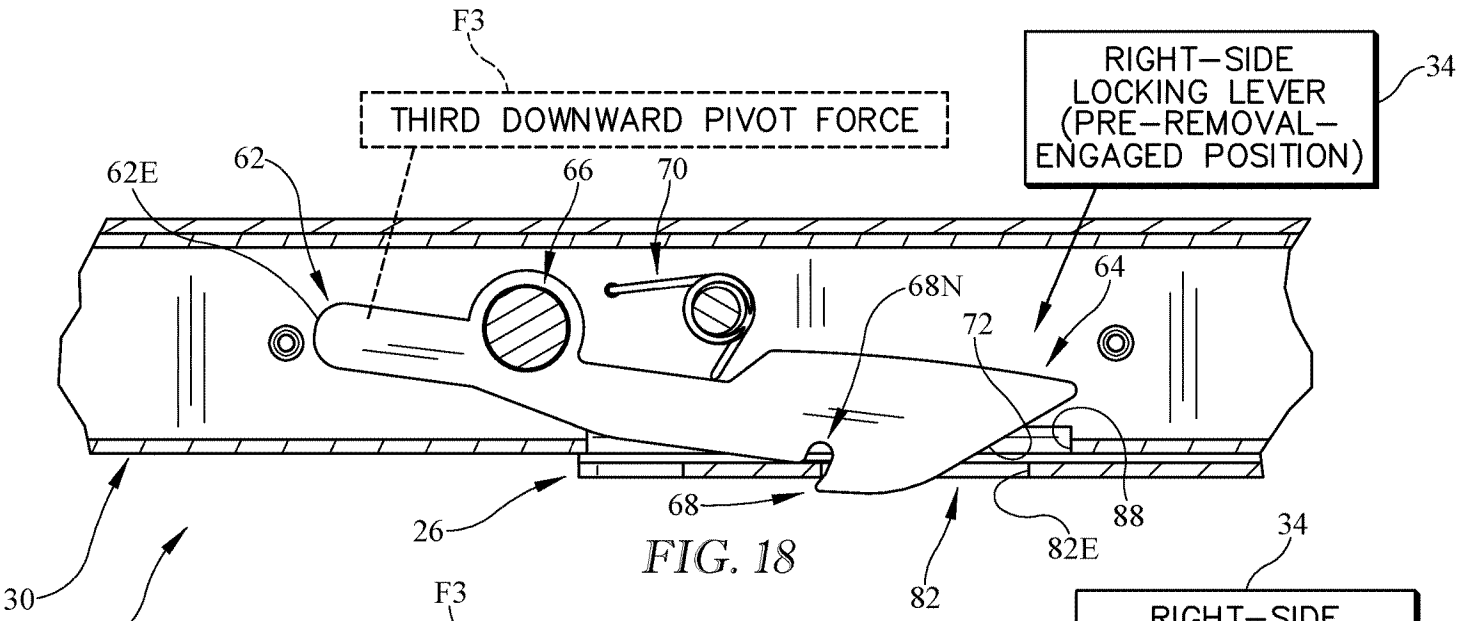
Figure 19:
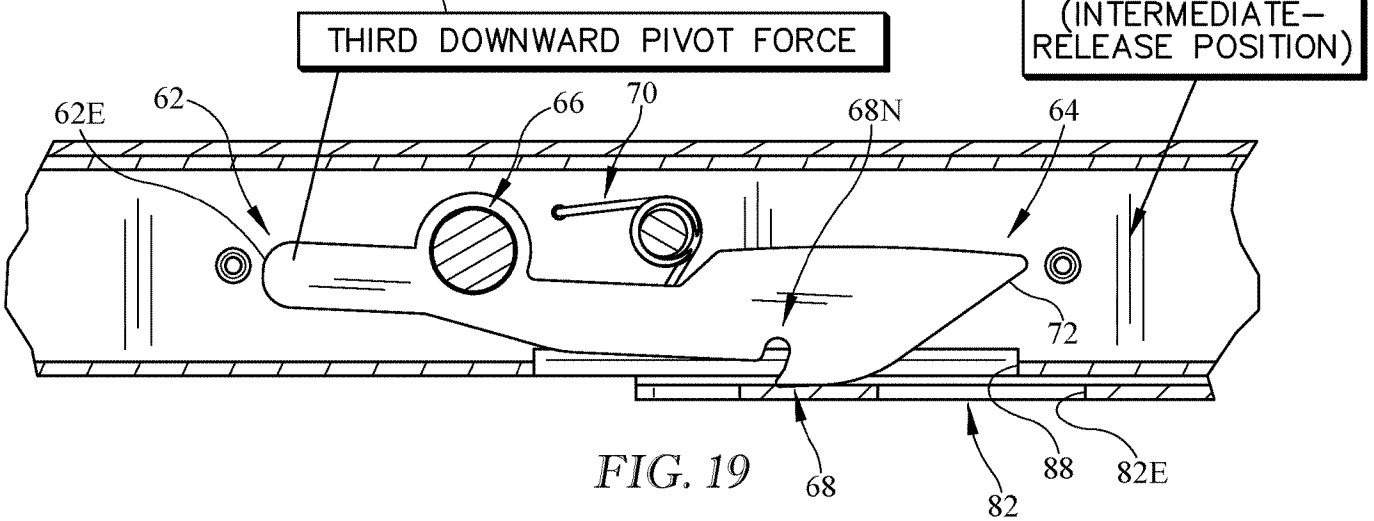
Figure 20:
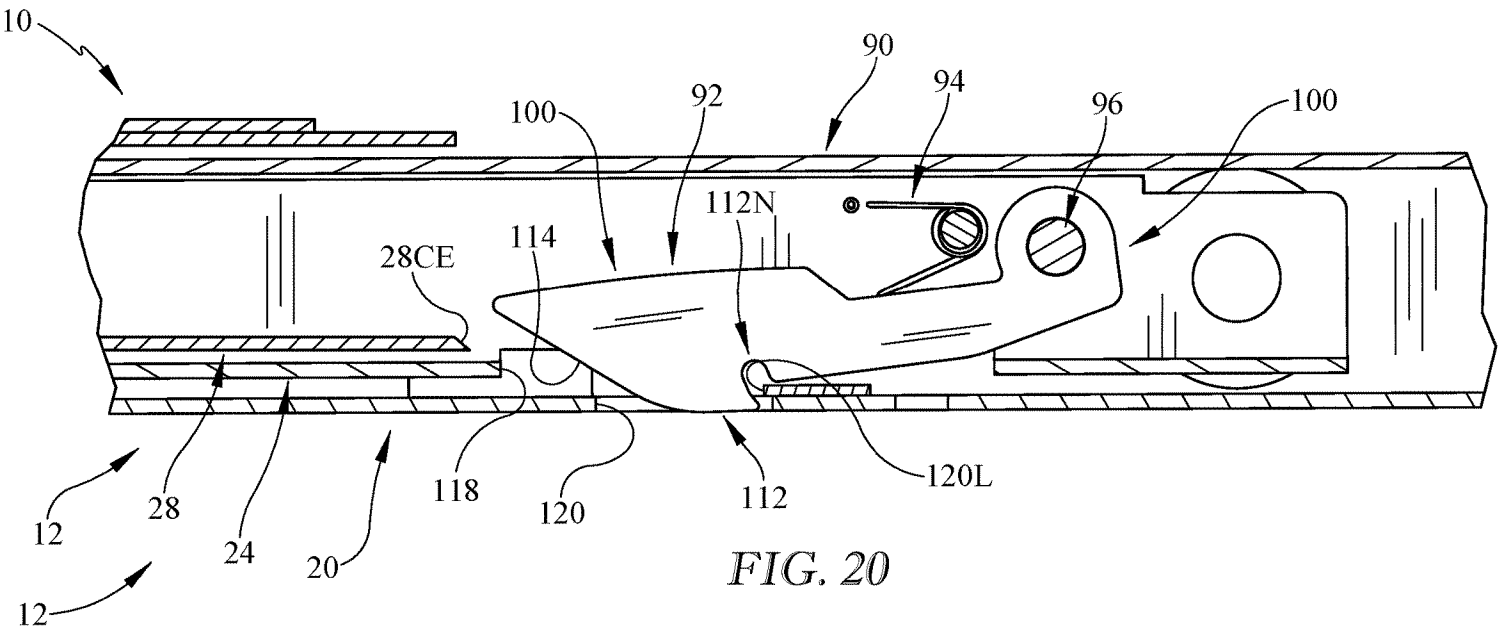
Figure 21:
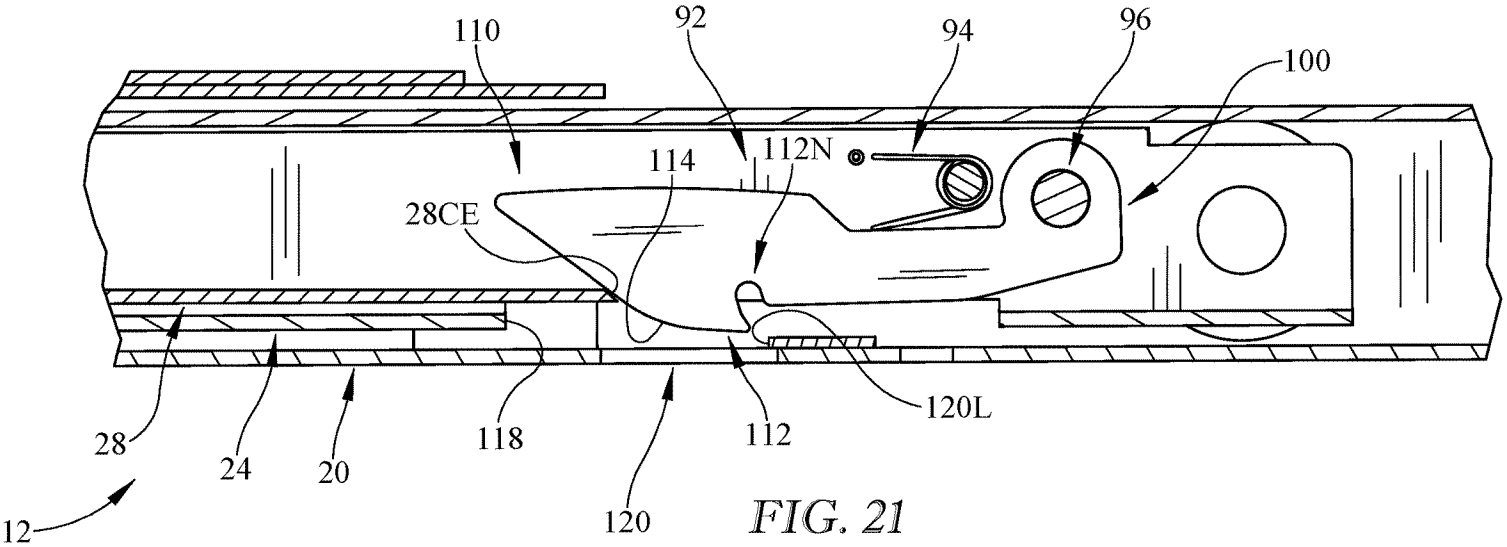
Figure 22:
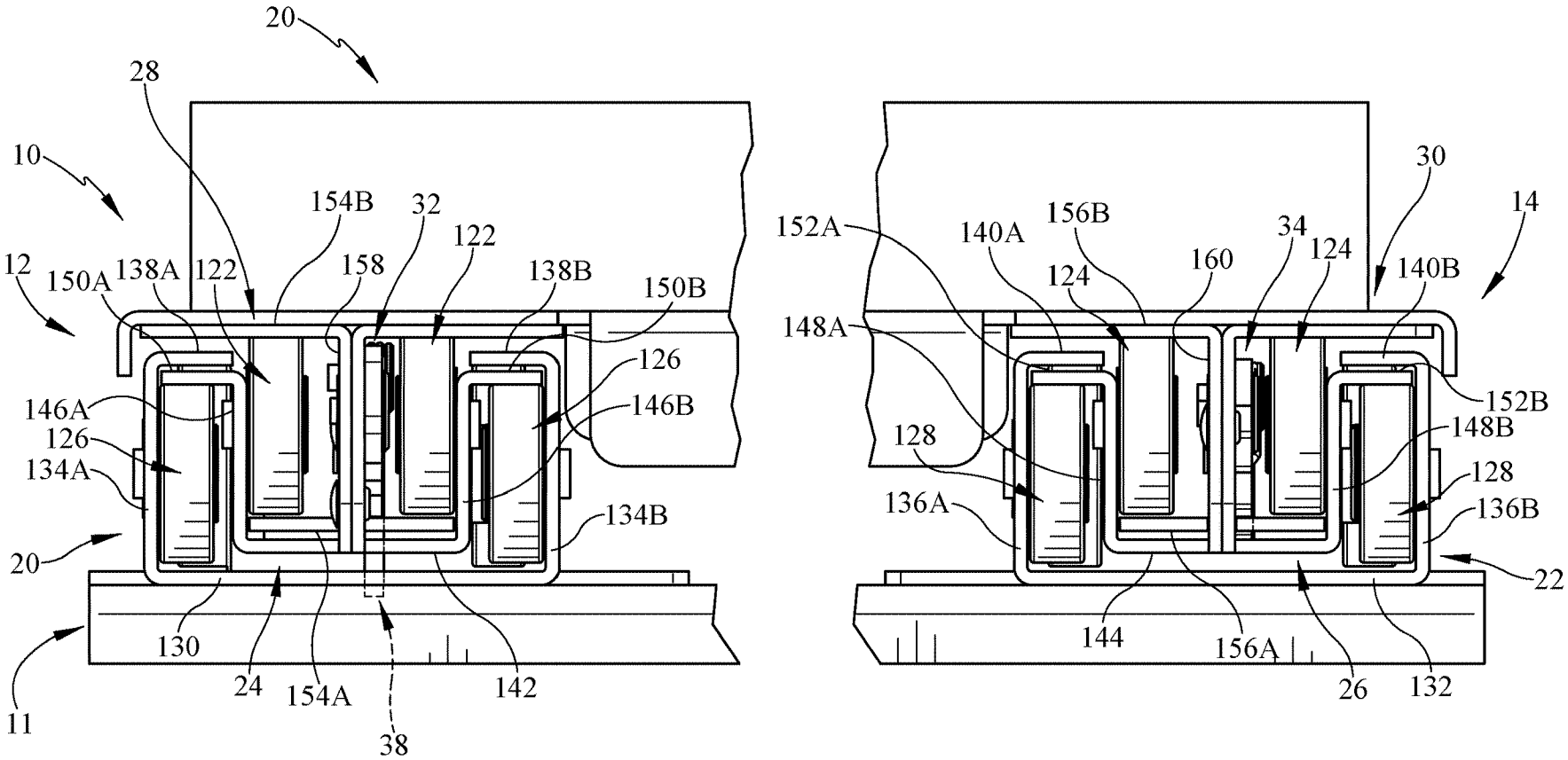

FIG. 7R is a detail view of FIG. 7 showing the right-side locking lever of the toolless release feature in the SERVICE-UNRESTRICTED position in which the locker head of the right-side locking lever remains free so that the right-side locking lever does not block the load-carrying and intermediate slide members of the right-side telescoping slide assembly from moving relative to the stationary slide member;

FIG. 8 is a perspective view similar to FIG. 7 showing the telescoping slide system in the PRE-REMOVAL stage with portions of the telescoping slide assemblies broken away to show the left-side locking lever of the toolless release feature in the PRE-REMOVAL-RELEASED position and the right-side locking lever of the toolless release feature in the PRE-REMOVAL-ENGAGED position;

FIG. 8L is a detail view of FIG. 8 showing the left-side locking lever of the toolless release feature in the PRE-REMOVAL-RELEASED position in which the locker head of the left-side locking lever is spaced apart from the second set of locking apertures formed in the intermediate slide member of the left-side telescoping slide assembly, thereby allowing the telescoping slide system to be moved to the PRE-REMOVAL stage;

FIG. 8R is a detail view of FIG. 8 showing the right-side locking lever of the toolless release feature in the PRE-REMOVAL-ENGAGED position in which the locker head of the right-side locking lever extends into a locking aperture formed in the intermediate slide member on the right-side telescoping slide assembly, thereby locking the telescoping slide system in the PRE-REMOVAL stage before the piece of equipment is fully removed from the storage rack to prevent any accidental removal of the equipment from the storage rack;

FIG. 9 is a perspective view similar to FIG. 9 showing the telescoping slide system in the REMOVAL stage in which the piece of equipment has been fully removed and is spaced apart from the storage rack, and showing both the left-side locking lever and the right-side locking lever of the toolless release feature are in the REMOVAL positions in the REMOVAL stage so that the load-carrying slide members are free to be removed from the respective telescoping slide assemblies;

FIG. 9L is a detail view of FIG. 9 showing the left-side locking lever of the toolless release feature in the REMOVAL position in which the locker head of the left-side locking lever does not engage either of the intermediate or stationary slide members of the left-side telescoping slide assembly;

FIG. 9R is a detail view of FIG. 9 showing the right-side locking lever of the toolless release feature in the REMOVAL position in which the locker head of the right-side locking lever does not engage either of the intermediate or stationary slide members of the right-side telescoping slide assembly;

FIG. 10 is a section view of the telescoping slide system in the RETRACTED-STORAGE stage showing the left-side locking lever of the toolless release feature includes an elongated release handle pivotably coupled to the load-carrying slide member of the left-side telescoping slide assembly and the locker head which has locking lugs that cooperate to lock the telescoping slide system in the RETRACTED-STORAGE stage, and further showing the handle is configured to be engaged with a first downward pivot force to pivot the left-side locking lever between the STORAGE-ENGAGED position and an INTERMEDIATE-RELEASED position so that the telescoping slide system may be moved from the RETRACTED-STORAGE stage to the EXTENDED-SERVICE stage;

FIG. 10A is a detail view of FIG. 10 showing the locking lugs formed on the locker head of the left-side locking lever extend into corresponding locking apertures included in the first set of locking apertures to block movement of the telescoping slide assembly when the telescoping slide assembly is in the RETRACTED-STORAGE stage;

FIG. 11 is a section view similar to FIG. 10 showing the first downward pivot force has been applied to the handle of the left-side locking lever to cause the left-side locking lever to pivot in a counterclockwise direction to the INTERMEDIATE-RELEASED position so that the load-carrying and intermediate slide members of each slide assembly are free to move to the left relative to the stationary slide member toward the EXTENDED-SERVICE stage;

FIG. 11A is a detail view of FIG. 11 showing the locking lugs formed on the locker head of the left-side locking lever are spaced apart from the corresponding locking apertures included in the first set of locking apertures after the first downward pivot force has been applied to the left-side locking lever to allow the load-carrying and intermediate slide members of each slide assembly to move relative to the stationary slide member;

FIG. 12 is a section view similar to FIG. 11 showing one of the locking lugs formed on the locker head of the left-side locking lever of the toolless release feature is shaped to include a lifting ramp that is configured to block the left-side locking lever of the toolless release feature from engaging a locking aperture included in the second set of locking apertures formed in the intermediate slide member, thereby preventing establishment of a locked connection at a partly extended stage during movement of the telescoping slide assembly from the RETRACTED-STORAGE stage to the EXTENDED-SERVICE stage;

FIG. 13 is a section view similar to FIG. 12 showing the left-side locking lever has moved to the SERVICE-ENGAGED position in which the locker head of the left-side locking lever of the toolless release feature extends into the second set of locking apertures formed in the intermediate slide member on the left-side telescoping slide assembly, thereby locking the telescoping slide system in the EXTENDED-SERVICE stage and preventing the load-carrying members of each slide assembly from moving relative to the intermediate slide members back to the RETRACTED-STORAGE stage and/or from being removed from the respective slide assemblies;

FIG. 14 is a section view similar to FIG. 13 showing the release handle of the left-side locking lever of the toolless release feature is configured to be engaged with a second downward pivot force to pivot the left-side locking lever of the toolless release feature between the SERVICE-ENGAGED position and the INTERMEDIATE-RELEASED position so that the telescoping slide assembly may be moved from the EXTENDED-SERVICE stage to either the RETRACTED-STORAGE stage to move the piece of equipment back into the storage rack or the PRE-REMOVAL stage to begin removing the piece of equipment from the storage rack;

FIG. 14A is a detail view of FIG. 14 showing the locking lugs formed on the locker head of the left-side locking lever of the toolless release feature extend into corresponding locking apertures included in the second set of locking apertures formed in the intermediate slide member of the left-side slide assembly to block movement of the telescoping slide system when the telescoping slide system is in the EXTENDED-SERVICE stage;

FIG. 15 is a section view similar to FIG. 14 showing the second downward pivot force has been applied to the release handle of the left-side locking lever of the toolless release feature to cause the left-side locking lever to pivot in the counterclockwise direction to the INTERMEDIATE-RELEASED position so that the load-carrying slide members of each slide assembly are free to move to the left relative to the corresponding intermediate slide members toward the PRE-REMOVAL stage;

FIG. 15A is a detail view of FIG. 15 showing the locking lugs formed on the locker head of the left-side locking lever of the toolless release feature are spaced apart from the corresponding locking apertures included in the second set of locking apertures after the second downward pivot force has been applied to the left-side locking lever;

FIG. 16 is a section view of the telescoping slide assembly in the extended service storage stage showing the right-side locking lever of the toolless release feature in the SERVICE-UNRESTRICTED position, and further showing the right-side locking lever of the toolless release feature includes a release handle pivotably coupled to the load-carrying slide member of the right-side telescoping slide assembly and a locker head that has a hook configured to engage the intermediate slide member of the right-side telescoping slide assembly to lock the telescoping slide system in the PRE-REMOVAL stage;

FIG. 17 is a view similar to FIG. 16 showing the telescoping slide assembly has moved from the EXTENDED-SERVICE stage to the PRE-REMOVAL stage to cause the right-side locking lever of the toolless release feature to pivot in a clock-wise direction so that the hook formed on the locker head of the right-side telescoping slide assembly extends into a locking aperture formed in the intermediate slide member on the right-side telescoping slide assembly, thereby locking the telescoping slide system in the PRE-REMOVAL stage;

FIG. 18 is a view similar to FIG. 17 showing the release handle of the right-side locking lever of the toolless release feature is configured to be engaged with a third downward pivot force to pivot the right-side locking lever of the toolless release feature between the PRE-REMOVAL-ENGAGED position and an INTERMEDIATE-RELEASED position so that the telescoping slide system may be moved from the PRE-REMOVAL stage to the REMOVAL stage, and further showing the locker head of the right-side locking lever further includes a lift ramp that is configured to pivot the right-side locking lever out of the locking aperture formed in the intermediate slide member on the right-side telescoping slide assembly when the telescoping slide system is moved from the PRE-REMOVAL stage back to the EXTENDED-SERVICE stage;

FIG. 19 is a view similar to FIG. 18 showing the third downward pivot force has been applied to the right-side locking lever of the toolless release feature to cause the right-side locking lever to pivot in a counterclockwise direction to the INTERMEDIATE-RELEASED position so that the load-carrying slide members of each slide assembly are free to move to the left relative to the corresponding intermediate slide members toward the REMOVAL stage;

FIG. 20 is a section view of the telescoping slide system in the EXTENDED-SERVICE stage showing the telescoping slide system further includes an intermediate locking and unlocking mechanism coupled to the left-side telescoping slide assembly, and further showing the intermediate locking and unlocking mechanism includes a latch blade that is pivotably mounted on the intermediate slide member of the left-side telescoping slide assembly and arranged to extend through an aperture formed in the intermediate slide member to engage a lip formed in the stationary slide member of the left-side telescoping slide assembly to lock the intermediate slide member in a fully extended position relative to the stationary slide member as the telescoping slide system moves from the RETRACTED-STORAGE stage to the EXTENDED-SERVICE stage;

FIG. 21 is a sectional view similar to FIG. 20 showing the mechanism of FIG. 20 in an UNLOCKED position in which a forwardly-facing camming edge formed on the load-carrying slide member of the left-side telescoping slide assembly engages a forwardly-facing ramping surface formed on the latch blade to lift and pivot the latch blade upwardly away from the stationary slide member of the left-side telescoping slide assembly to disengage the latch blade from the lip in the stationary slide member, thereby allowing the intermediate slide member of the left-side telescoping slide assembly to move with the load-carrying slide member of the left-side telescoping slide assembly to the right relative to the stationary slide member toward the RETRACTED-STORAGE stage; and FIG. 22 is an end view of the left-side and right-side telescoping slide assemblies of the telescoping slide system showing each stationary slide member is mounted to the storage rack, each load-carrying slide member supports a portion of the equipment, and the each intermediate slide member is located therebetween, and further showing the load-carrying slide members are each supported for sliding movement in the corresponding intermediate slide member by rollers coupled to the intermediate slide member and the intermediate slide member is supported for sliding movement in the stationary slide member by rollers attached to the stationary slide member.

DETAILED DESCRIPTION

Figure 1:
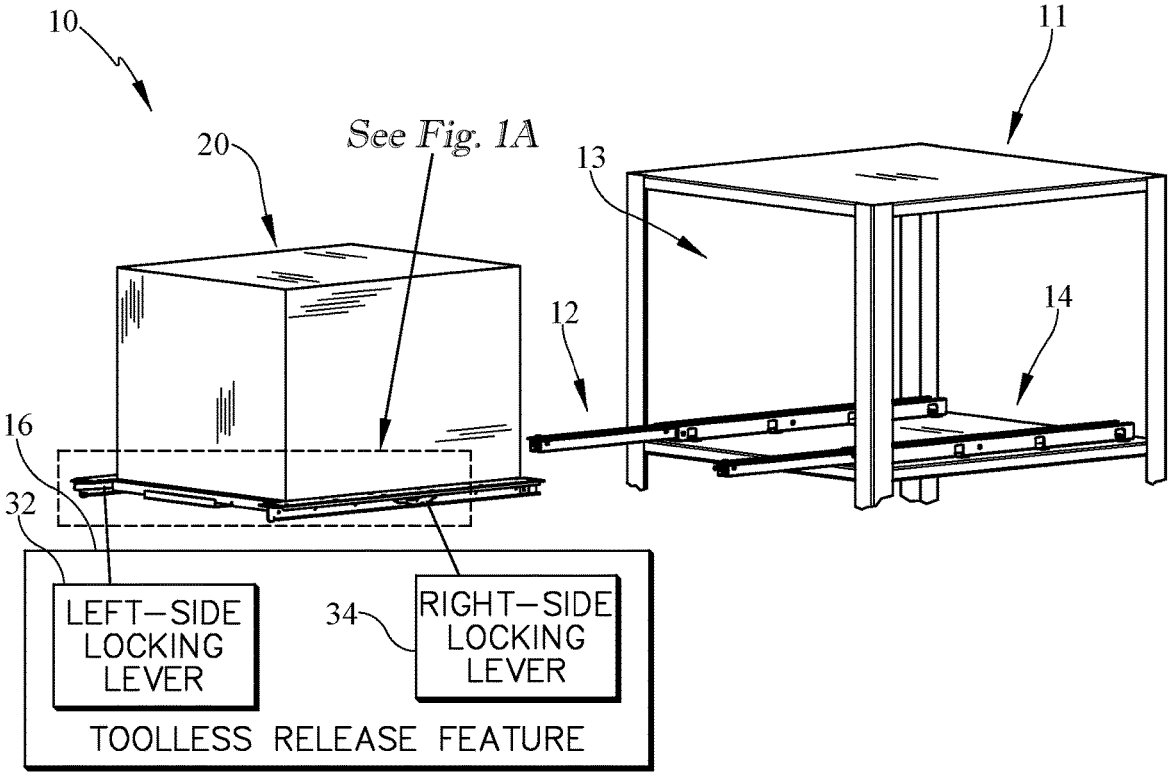
Figure 6:
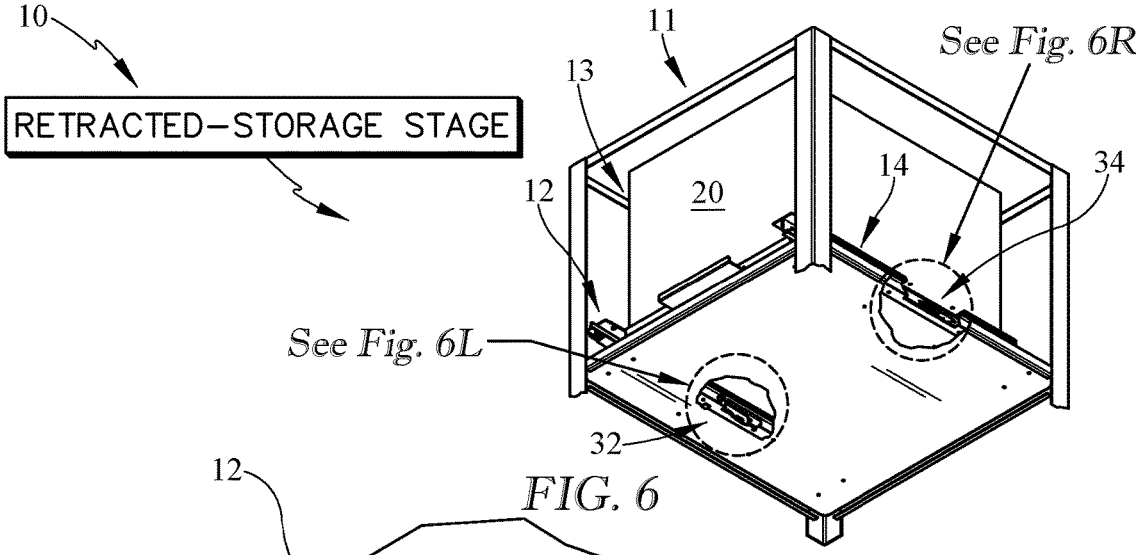

A telescoping slide system 10 illustrated in FIG. 1 includes a left-side telescoping slide assembly 12, a right-side telescoping slide assembly 14, and a toolless release feature 16. The left-side and right-side telescoping slide assemblies 12, 14 are movable to extend and retract among a RETRACTED-STORAGE stage as shown in FIG. 6, an EXTENDED-SERVICE stage as shown in FIG. 7, a PRE-REMOVAL stage as shown in FIG. 8, and a REMOVAL stage as shown in FIG. 9. The toolless release feature 16 controls movement of the telescoping slide assemblies 12, 14 between the RETRACED-STORAGE, EXTENDED-SERVICE, PRE-REMOVAL, and REMOVAL stages to enable a technician to remove a piece of equipment 18 mounted to load-carrying slide members of each telescoping slide assembly 12, 14 from a storage rack 11 without the use of any tools.

Figure 5:
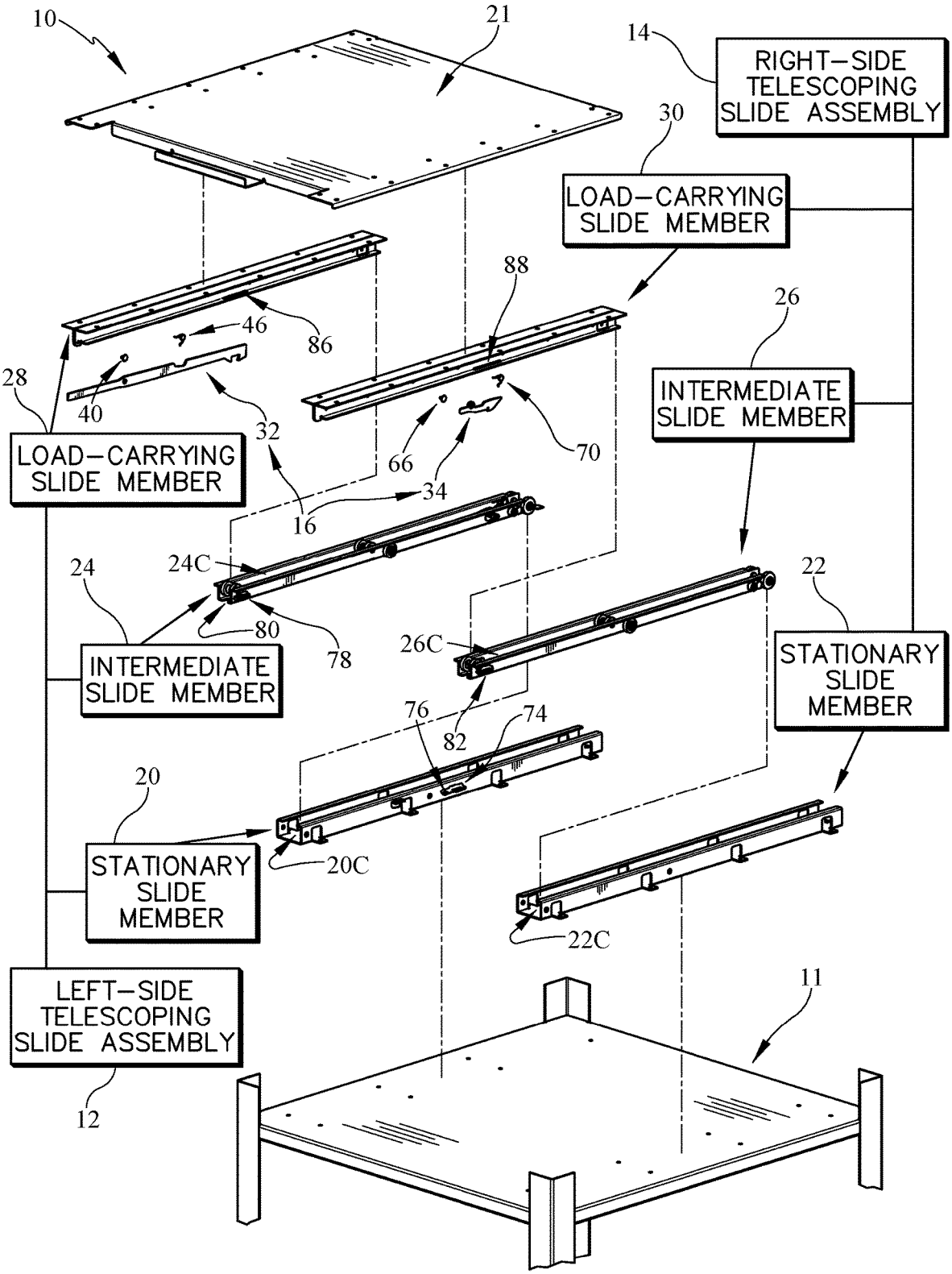

Each of the telescoping slide assemblies 12, 14 includes interconnected slide members moveable to extend and retract among the RETRACTED-STORAGE stage, the EXTENDED-SERVICE stage, the PRE-REMOVAL stage, and the REMOVAL stage. The slide members of each assembly 12, 14 include a stationary slide member 20, 22, an intermediate slide member 24, 26, and a load-carrying slide member 28, 30 as shown in FIG. 5. The intermediate slide member 24, 26 is configured to move relative to the corresponding stationary slide member 20, 22 in a channel 20C, 22C formed in the corresponding stationary slide member 20, 22. The load-carrying slide member 28, 30 is configured to move relative to the corresponding stationary and intermediate slide members 20, 22, 24, 26 in a channel 24C, 26C formed in the corresponding intermediate slide member 24, 26.

Figure 1A:
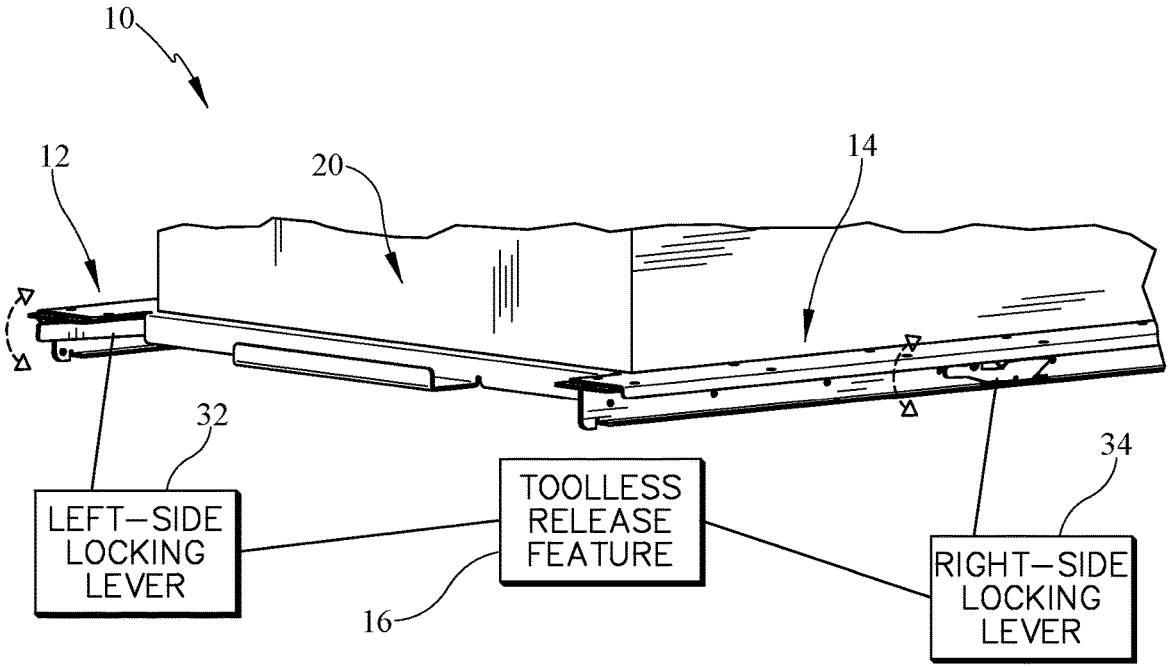

The toolless release feature 16 includes a left-side locking lever 32 and a right-side locking lever 34 as shown in FIG. 1A. The left-side locking lever 32 is pivotably coupled to the load-carrying slide member 28 of the left-side telescoping assembly 12. The right-side locking lever 34 is pivotably coupled to the load-carrying slide member 30 of the right-side telescoping slide assembly 14. The left-side locking lever 32 and the right-side locking lever 34 are each configured to pivot selectively relative to the corresponding load-carrying slide member 28, 30 to lock or release the load-carrying members 28, 30 between the RETRACTED-STORAGE stage, the EXTENDED-SERVICE stage, the PRE-REMOVAL stage, and the REMOVAL stage.

Figure 2:
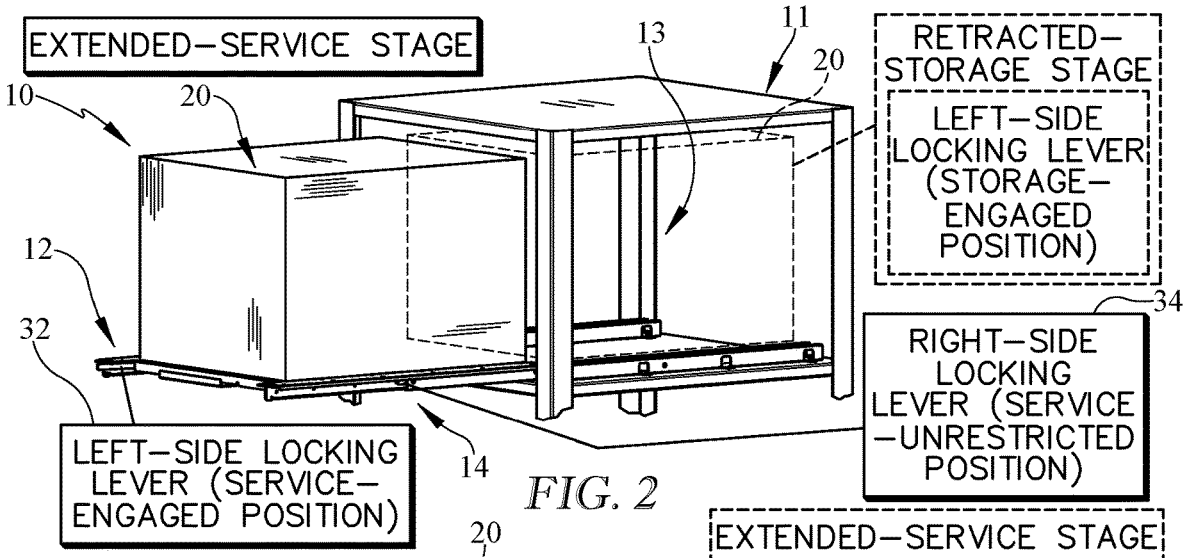

In the RETRACTED-STORAGE stage, the left-side locking lever 32 is in a STORAGE-ENGAGED position as suggested in FIG. 2, while the right-side locking lever is unrestricted. In the STORAGE-ENGAGED position, the left-side locking lever 32 blocks movement of the intermediate and load-carrying slide members 24, 26, 28, 30 of each telescoping slide assemblies 12, 14 relative to the stationary slide members 20, 22 coupled to the storage rack 11. This prevents the piece of equipment 18 from moving out of a storage space 13 of the storage rack 11 when the piece of equipment 18 is not being accessed by the technician.

To access the piece of equipment 18, the telescoping slide system 10 is moved from the RETRACTED-STORAGE stage to the EXTENDED-SERVICE stage as suggested in FIG. 2. The telescoping slide system 10 is moved from the RETRACTED-STORAGE stage to the EXTENDED-SERVICE stage by changing the left-side locking lever 32 of the toolless release feature 16 from the STORAGE-ENGAGED position as shown in 6L to a SERVICE-ENGAGED position as shown in FIG. 7L. By moving the telescoping slide system 10 from the RETRACTED-STORAGE stage to the EXTENDED-SERVICE stage, the piece of equipment 18 is moved out of the storage space 13 of the storage rack 11.

In the EXTENDED-SERVICE stage, the left-side locking lever 32 of the toolless release feature 16 is in the SERVICE-ENGAGED position as shown in FIG. 2. In the SERVICE-ENGAGED position, the left-side locking lever 32 blocks the intermediate and load-carrying members 24, 26, 28, 30 of each telescoping slide assembly 12, 14 from movement relative to the stationary slide members 20, 22 to allow the technician to safely access the piece of equipment 18.

Figure 3:
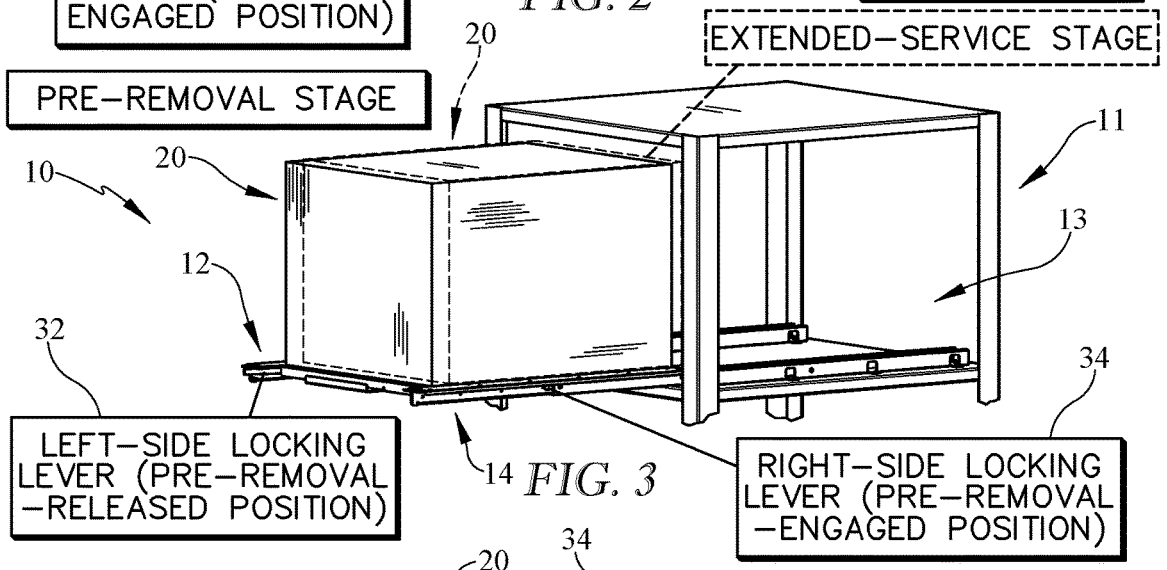

To begin removing the piece of equipment 18 from the storage rack 11, the telescoping slide system 10 is moved from the EXTENDED-SERVICE stage to the PRE-REMOVAL stage as shown in FIG. 3. The telescoping slide system 10 is moved from the EXTENDED-SERVICE stage to the PRE-REMOVAL stage by changing the left-side locking lever 32 of the toolless release feature 16 from the SERVICE-ENGAGED position to a PRE-REMOVAL-RELEASED position as shown in FIG. 8L.

In the PRE-REMOVAL-RELEASED position, the left-side locking lever 32 of the toolless release feature 16 is released from the intermediate slide member 24 of the left-side slide assembly 12 to allow the telescoping slide system 10 to move toward the REMOVAL stage. The movement of the telescoping slide system 10 toward the REMOVAL stage causes the right-side locking lever 34 of the toolless release feature to change from a SERVICE-UNRESTRICTED position as shown in FIG. 7R to a PRE-REMOVAL-ENGAGED position as shown in FIG. 8R.

In the REMOVAL-ENGAGED position, the right-side locking lever 34 blocks immediate removal of the load-carrying members 28, 30 of each telescoping slide assembly 12, 14 from the intermediate and stationary slide members 20, 22, 24, 26. By blocking immediate removal of the load-carrying members 28, 30, the right-side locking lever 34 prevents any accidental removal of the equipment 18 from the storage rack 11.

Figure 4:
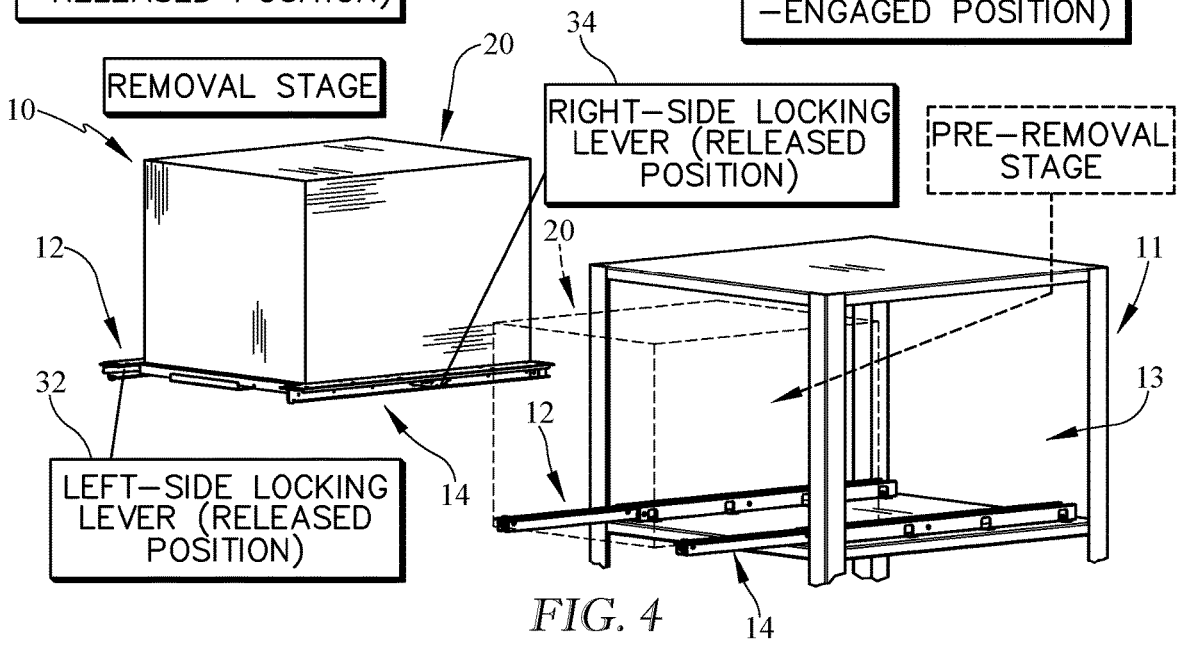

To finish removing the piece of equipment 18 from the storage rack 11, the telescoping slide system 10 is moved from the PRE-REMOVAL stage to the REMOVAL as shown in FIG. 4. The telescoping slide system 10 is moved from the PRE-REMOVAL stage to the REMOVAL stage by changing the right-side locking lever 34 of the toolless release feature 16 from the PRE-REMOVAL-ENGAGED position to a RELEASED position as shown in FIG. 9R. In this way, the load-carrying members 28, 30 of each telescoping slide assembly 12, 14 are removed from the intermediate and stationary slide members 20, 22, 24, 26, thereby allowing the piece of equipment 18 to be fully separated from the storage rack 11.

In the illustrative embodiment, the left-side locking lever 32 of the toolless release feature 16 is configured to be coupled to the load-carrying slide member 28 of the left-side telescoping slide assembly 12 and the right-side locking lever 34 of the toolless release feature 16 is configured to be coupled to the load-carrying slide member 30 of the right-side telescoping slide assembly 14 as shown in FIG. 5. The stationary and intermediate carriers 20, 22, 24, 26 include locking apertures 74, 76, 78, 80, 82 that are configured to be engaged by the left and right-side locking levers 32, 34 at each of the corresponding stages.

In FIG. 6, the telescoping slide system 10 is in the RETRACTED-STORAGE stage. Portions of the storage rack 11 and the telescoping slide assemblies 12, 14 are broken away to show the left-side locking lever 32 of the toolless release feature 16 in the STORAGE-ENGAGED position as shown in FIG. 6L and the right-side locking lever 34 of the toolless release feature 16 in the STORAGE-UNRESTRICTED position as shown in FIG. 6R.

Figure 6L:
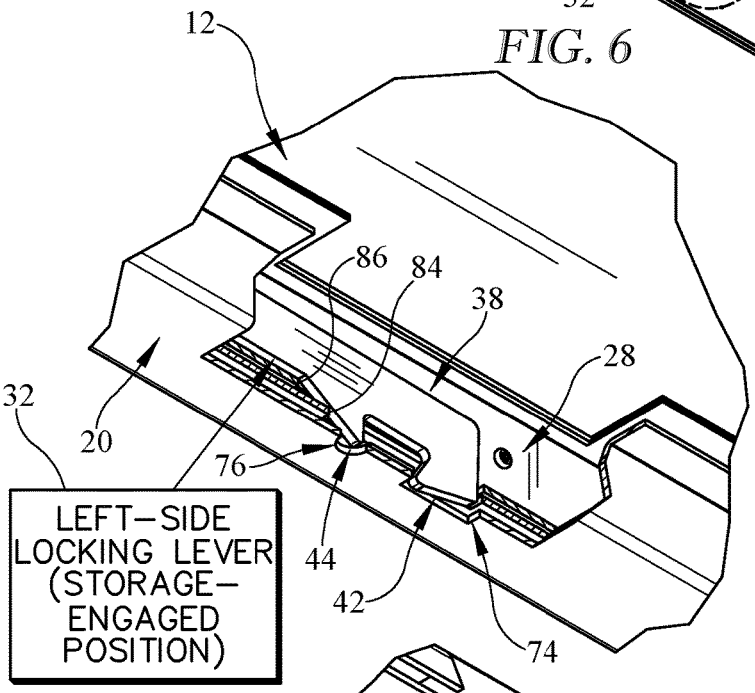

When the left-side locking lever 32 is in the STORAGE-ENGAGED position, a locker head 38 formed on the left-side locking lever 32 extends into a first set of locking apertures 74, 76 formed in the intermediate and stationary slide members 20, 24 on the left-side telescoping slide assembly 12 as shown in FIGS. 6L and 10. The locker head 38 extends into the first set of locking apertures 74, 76 to lock the telescoping slide system in the RETRACTED-STORAGE stage. This prevents the telescoping slide system 10 from moving relative to the storage rack 11 when the technician is not accessing the telescoping slide system 10.

Figure 6R:
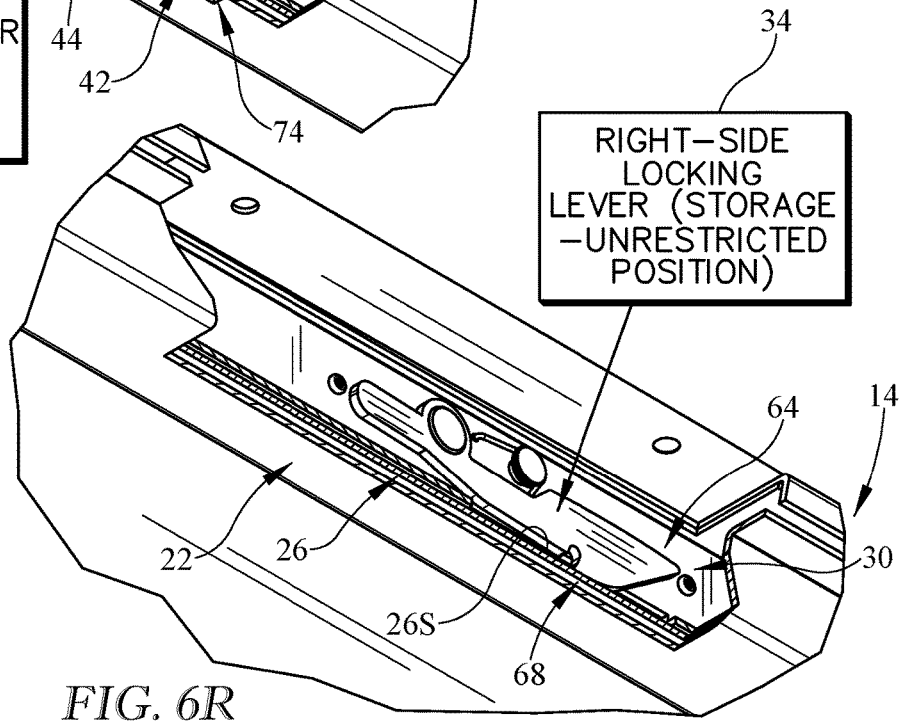

When the right-side locking lever 34 is in the STORAGE-UNRESTRICTED position, a locker head 64 formed on the right-side locking lever 34 abuts an inner surface 26S of the intermediate slide member 26 as shown in FIG. 6R. The right-side locking lever 34 does not block the load-carrying and intermediate slide members 30, 26 of the right-telescoping slide assembly 14 from moving relative to the stationary slide member 22 so that when the left-side locking lever 32 is released, the telescoping slide system 10 is free to move between the RETRACTED-STORAGE stage and the EXTENDED-SERVICE stage.

In FIG. 7, the telescoping slide system 10 in the EXTENDED-SERVICE stage. Portions of the telescoping slide assemblies 12, 14 are broken away to show the left-side locking lever 32 of the toolless release feature 16 in the SERVICE-ENGAGED position as shown in FIG. 7L and the right-side locking lever 34 of the toolless release feature 16 in the SERVICE-UNRESTRICTED position as shown in FIG. 7R.

When the left-side locking lever 32 is in the SERVICE-ENGAGED position, the locker head 38 of the left-side locking lever 32 extends into a second set of locking apertures 78, 80 formed in the intermediate slide member 24 of the left-side telescoping slide assembly 12 as shown in FIGS. 7L and 13. The locker head 38 extends into the second set of locking apertures 78, 80 to lock the telescoping slide system in the EXTENDED-SERVICE stage. This prevents the telescoping slide system 10 from moving relative to the storage rack 11 when the technician is accessing the telescoping slide system 10.

When the right-side locking lever 34 is in the SERVICE-UNRESTRICTED position, the locker head 64 of the right-side locking lever 32 remains free as shown in FIGS. 7R and 16. The locker head 64 remains free so that the right-side locking lever 14 does not block the load-carrying and intermediate slide members 30, 26 of the right-side telescoping slide assembly 14 from moving relative to the stationary slide member 22 when the left-side locking lever 32 is released.

In FIG. 8, the telescoping slide system 10 is in the PRE-REMOVAL stage. Portions of the telescoping slide assemblies 12, 14 are broken away to show the left-side locking lever 32 of the toolless release feature 16 in the PRE-REMOVAL-RELEASED position as shown in FIG. 8L and the right-side locking lever 34 of the toolless release feature 16 in the PRE-REMOVAL-ENGAGED position as shown in FIG. 8R.

When the left-side locking lever 32 is in the PRE-REMOVAL-RELEASED position, the locker head 38 of the left-side locking lever 32 is spaced apart from the second set of locking apertures 78, 80 formed in the intermediate slide member 24 of the left-side telescoping slide assembly 12 as shown in FIGS. 8L and 15. This allows the telescoping slide system 10 to be moved to the PRE-REMOVAL stage.

When the right-side locking lever 34 is in the PRE-REMOVAL-ENGAGED position, the locker head 64 of the right-side locking lever 34 extends into a locking aperture 82 formed in the intermediate slide member 26 on the right-side telescoping slide assembly 14 as shown in FIGS. 8R and 17. The locker head 64 of the right-side locking lever 34 extends into the locking aperture 82 to lock the telescoping slide system 10 in the PRE-REMOVAL stage before the piece of equipment 18 is fully removed from the storage rack 11 to prevent any accidental removal of the equipment 18 from the storage rack 11.

In FIG. 9, the telescoping slide system 10 is in the REMOVAL stage in which the piece of equipment 18 has been fully removed and is spaced apart from the storage rack 11. Both the left-side locking lever 32 and the right-side locking lever 34 of the toolless release feature 16 are in the REMOVAL positions as shown in FIGS. 9L and 9R in the REMOVAL stage. With the left-side locking lever 32 and the right-side locking lever 34 in the REMOVAL positions, the load-carrying slide members 28, 30 are free to be removed from the respective telescoping slide assemblies 12, 14.

When the left-side locking lever 32 of the toolless release feature 16 is in the REMOVAL position, the locker head 38 of the left-side locking lever 32 does not engage either of the intermediate or stationary slide members 24, 20 of the left-side telescoping slide assembly 12 as shown in FIG. 9L. When the right-side locking lever 34 of the toolless release feature 16 is in the REMOVAL position, the locker head 64 of the right-side locking lever 34 does not engage either of the intermediate or stationary slide members 26, 22 of the right-side telescoping slide assembly 14 as shown in FIG. 9R.

The left-side locking lever 32 includes an elongated release handle 36 and the locker head 38 as shown in FIG. 10. A rivet 40 pivotably couples the release handle 36 of the locking lever 32 to the load-carrying slide member 28. The locking lever 32 is positioned so that a distal end portion 36E of the handle 36 extends beyond the distal end 28E of the load-carrying slide member 28.

The locker head 38 is shaped to include locking lugs 42, 44 as shown in FIGS. 10-15A. The locking lugs 42, 44 cooperate to lock the telescoping slide system 10 in the RETRACTED-STORAGE stage as shown in FIGS. 10 and 10A and the EXTENDED-SERVICE stage as shown in FIGS. 13, 14, and 14A.

In the illustrative embodiment, the left-side locking lever 32 is spring loaded so that the left-side locking lever 32 is biased toward the STORAGE-ENGAGED position in the RETRACTED-STORAGE stage and the SERVICE-ENGAGED position in the EXTENDED-SERVICE stage as shown in FIGS. 10 and 14. A spring 48 is positioned between the load-carrying slide member 28 and the handle 36 of the locking lever 32 as shown in FIGS. 10 and 11. The spring 48 biases the locking lever 32 toward the ENGAGED positions.

When the telescoping slide system 10 is in the RETRACTED-STORAGE stage as shown in FIG. 10A, the first set of locking apertures 74, 76 formed in the stationary slide member 20 are vertically aligned with locking apertures 84, 86 formed in the intermediate and load-carrying slide members 24, 28. The locker head 38 of the locking lever 32 is urged downwardly by the action of the spring 48 to extend the locking lugs 42, 44 into the locking apertures 74, 76, 84, 86 to engage the stationary slide member 20 to lock the telescoping slide system 10 in the RETRACTED-STORAGE stage as shown in FIG. 10A. The spring 48 urges the front-locking lug 42 into the locking aperture 74 and the back-locking lug 44 into the locking aperture 76 to establish the STORAGE-ENGAGED position.

The locking lugs 42, 44 are situated in spaced-apart relation to form a notch 46 therebetween in the locker head 38 of the left-side locking lever 32 as shown in FIGS. 10-15A. The notch 46 is defined by a forward vertical edge 52, a rear angled edge 54, and a horizontal edge 56 extending between the rear angled edge 54 and the forward vertical edge 52. The angled edge 54 of the notch 46 meets a bottom edge 58 of the locker head 38 as shown in FIGS. 10A and 11A to form a forwardly extending rounded lip 60. The lip 60 engages a complementary shoulder 74S formed on the stationary slide member 20 when the locking lever 32 is in the STORAGE-ENGAGED position.

The back-locking lug 44 is shaped to define an inclined lifting ramp 50 as shown in FIGS. 10A and 11A. The lifting ramp 50 is provided on a forward facing edge of the locking lug 44. Lifting ramp 50 fits into the locking aperture 76 formed in the stationary slide member 20 whenever the telescoping slide system 10 is moved to the RETRACTED-STORAGE stage as shown in FIG. 10A. The lifting ramp 50 cooperates with vertical edge 52 to define a triangular shape of locking lug 44 that extends downwardly away from the locker head 38.

To move the telescoping slide system 10 from the RETRACTED-STORAGE stage to the EXTENDED-SERVICE stage, the handle 36 is configured to be engaged with a first downward pivot force F1 as shown in FIGS. 10 and 11. The first downward pivot force F1 causes the left-side locking lever 32 to pivot between the STORAGE-ENGAGED position as shown in FIG. 10 and an INTERMEDIATE-RELEASED position as shown in FIG. 11. In the INTERMEDIATE-RELEASED position, the locker head 38 of the left-side locking lever 32 is spaced apart from the locking apertures 74, 76.

The first downward pivot force F1 is applied to the handle 36 of the left-side locking lever 32 to overcome the bias force applied by the spring 48 to the locking lever 32 and to cause the left-side locking lever 32 to pivot in a counterclockwise direction to the INTERMEDIATE-RELEASED position as shown in FIG. 11. By pivoting in the counterclockwise direction, the locking lugs 42, 44 move out of and away from the locking apertures 74, 76 to disengage the locking lever 32 from the stationary slide member 20.

Once the locker head 38 of locking lever 32 has been disengaged from the locking apertures 74, 76, the intermediate and load-carrying slide members 24, 26, 28, 30 are free to move together relative to the stationary slide members 20, 22. In the INTERMEDIATE-RELEASED position, the locking lugs 42, 44 formed on the locker head 38 of the left-side locking lever 32 are spaced apart from the corresponding locking apertures 74, 76 as shown in FIG. 11A. This allows the intermediate and load-carrying slide members 24, 26, 28, 30 of each slide assembly 12, 14 to move to the left relative to the stationary slide members 20, 22 toward the EXTENDED-SERVICE stage to extend the telescoping slide system 10.

In FIG. 12, the telescoping slide system 10 is moving to the left, as suggested by the arrow A, toward the EXTENDED-SERVICE stage to extend the telescoping slide system 10. This moves the locker head 38 of the left-side locking lever 32 toward the second set of locking apertures 78, 80 formed in the intermediate slide member 24.

The lifting ramp 50 on the locker head 38 of the left-side locking lever 32 is configured to block the left-side locking lever 32 of the toolless release feature 16 from engaging any other holes formed in the intermediate slide member 24 as the telescoping slide system 10 moves toward the EXTENDED-SERVICE stage. For example, lifting ramp 50 is configured to block the left-side locking lever 32 of the toolless release feature 16 from engaging the locking aperture 78 the included in the second set of locking apertures 78, 80 as the telescoping slide system 10 moves toward the EXTENDED-SERVICE stage. The lifting ramp 50 thereby prevents establishment of a locked connection at a partly extended stage during movement of the telescoping slide assembly from the RETRACTED-STORAGE stage to the EXTENDED-SERVICE stage.

In FIG. 13, the left-side locking lever 32 has moved to the SERVICE-ENGAGED position. In the SERVICE-ENGAGED position, the locker head 38 of the left-side locking lever 32 of the toolless release feature 16 extends into the second set of locking apertures 78, 80 formed in the intermediate slide member 24 on the left-side telescoping slide assembly 12. The locking lugs 42, 44 extend into the respective locking apertures 78, 80, thereby locking the telescoping slide system 10 in the EXTENDED-SERVICE stage. With the locking lugs 42, 44 engaged with the intermediate slide member 24 in the respective locking apertures 78, 80, the load-carrying members 28, 30 of each slide assembly 12, 14 is prevented from moving relative to the intermediate slide members 24, 26 back to the RETRACTED-STORAGE stage and/or from being removed from the respective slide assemblies 12, 14.

From the EXTENDED-SERVICE stage, the telescoping slide system 10 may be moved back to the RETRACTED-STORAGE stage to move the piece of equipment 20 back into the storage rack. Alternatively, the telescoping slide system 10 may be moved to the PRE-REMOVAL stage from the EXTENDED-SERVICE stage to begin removing the piece of equipment 20 from the storage rack 11.

To move the telescoping slide system 10 from the EXTENDED-SERVICE stage to one of the RETRACTED-STORAGE stage or the PRE-REMOVAL stage, the handle 36 of the left-side locking lever 32 is configured to be engaged with a second downward pivot force F2 as shown in FIGS. 14 and 15. The second downward pivot force F2 is applied to the handle 36 of the left-side locking lever 32 to overcome the bias force applied by the spring 48 to the locking lever 32 while the left-side and right-side telescoping slide assemblies are in the EXTENDED-SERVICE stage. The second downward pivot force F2 causes the left-side locking lever 32 to pivot between the SERVICE-ENGAGED position as shown in FIG. 14 and the INTERMEDIATE-RELEASED position as shown in FIG. 15. In the INTERMEDIATE-RELEASED position, the locker head 38 of the left-side locking lever 32 is spaced apart from the locking apertures 78, 80.

With the left-side locking lever 32 in the INTERMEDIATE-RELEASED position, the intermediate and load-carrying slide members 24, 26, 28, 30 may be moved to the right back toward the RETRACTED-STORAGE stage. Alternatively, the load-carrying slide members 28, 30 may be moved to the left toward the PRE-REMOVAL stage once the left-side locking lever 32 is in the INTERMEDIATE-RELEASED position.

When the telescoping slide system 10 is in the EXTENDED-SERVICE stage as shown in FIG. 14A, the second set of locking apertures 78, 80 formed in the intermediate slide member 24 are vertically aligned with the locking aperture 86 formed in the load-carrying slide member 28. The locker head 38 of the locking lever 32 is urged downwardly by the action of the spring 48 to extend the locking lugs 42, 44 into the locking apertures 78, 80, 86 to engage the intermediate slide member 24 to lock the telescoping slide system 10 in the EXTENDED-SERVICE stage as shown in FIG. 14A. The spring 48 urges the front-locking lug 42 into the locking aperture 78 and the back-locking lug 44 into the locking aperture 80 to establish the SERVICE-ENGAGED position to block movement of the telescoping slide system 10 when the telescoping slide system is in the EXTENDED-SERVICE stage.

After the second downward pivot force F2 has been applied to the release handle 36 of the left-side locking lever 32 of the toolless release feature 16 as shown in FIG. 15, the left-side locking lever 32 is pivoted in the counterclockwise direction to the INTERMEDIATE-RELEASED position so that the locker head 38 is spaced apart from the locking apertures 78, 80 of the intermediate slide member 24. In the INTERMEDIATE-RELEASED position, the load-carrying slide members 28, 30 of each slide assembly 12, 14 are free to move to the left relative to the corresponding intermediate slide members 24, 26 toward the PRE-REMOVAL stage.

The locking lugs 42, 44 formed on the locker head 38 of the left-side locking lever 32 of the toolless release feature 16 are spaced apart from the corresponding locking apertures 78, 80 included in the second set of locking apertures 78, 80 as shown in FIG. 15A. The locking lugs 42, 44 are spaced apart from the corresponding locking apertures 78, 80 after the second downward pivot force F2 has been applied to the left-side locking lever 32 as shown in FIG. 15A.

The right-side locking lever 34 includes a release handle 62 and the locker head 64 as shown in FIGS. 16-19. A rivet 66 pivotably couples the release handle 62 of the locking lever 34 to the load-carrying slide member 30 of the right-side telescoping slide assembly 14. Unlike the left-side locking lever 32 of the left-side telescoping slide assembly 12, the right-side locking lever 34 is positioned so that a distal end portion 62E of the handle 62 does not extend beyond the distal end 30E of the load-carrying slide member 30. In this way, the release handle 62 of the right-side locking lever 34 is not likely to be accidently engaged by the technician trying to work on the piece of equipment 20 coupled to the slide system 10. Rather, the technician must intentionally engage the release handle 62 of the right-side locking lever 34 to remove the piece of equipment 20 from the storage rack 11.

The locker head 64 is shaped to include a hook 68 as shown in FIGS. 16-19. The hook 68 is configured to engage the intermediate slide member 26 of the right-side telescoping slide assembly 14 to lock the telescoping slide system 10 in the PRE-REMOVAL stage.

In the illustrative embodiment, the right-side locking lever 34 is spring loaded so that the right-side locking lever 34 is biased toward the PRE-REMOVAL-ENGAGED position as shown in FIGS. 16 and 17. A spring 70 is positioned between the load-carrying slide member 30 and the locker head 64 of the locking lever 24 as shown in FIGS. 16-19. The spring 70 biases the locking lever 34 toward the PRE-REMOVAL-ENGAGED position.

In the EXTENDED-SERVICE stage, the right-side locking lever 34 is in the SERVICE-UNRESTRICTED position as shown in FIG. 16. As the load-carrying slide members 28, 30 of each slide assembly 12, 14 move to the left relative to the corresponding intermediate slide members 24, 26 toward the PRE-REMOVAL stage, the spring 70 urges the locker head 64 of the right-side locking lever 34 to the PRE-REMOVAL-ENGAGED position as shown in FIG. 17.

As the load-carrying slide members 28, 30 of each slide assembly 12, 14 move toward the PRE-REMOVAL stage, the locking aperture 88 formed in the load-carrying slide member 30 aligns with the locking aperture 82 formed in the intermediate slide member 26 of the right-side telescoping slide assembly 14. Upon alignment of the locking apertures 82, 88 in the respective slide members 26, 30, the spring 70 causes the right-side locking lever 34 of the toolless release feature 16 to pivot in a clock-wise direction to the PRE-REMOVAL-ENGAGED position. In the PRE-REMOVAL-ENGAGED position, the hook 68 extends into the locking apertures 82, 88 and engages the intermediate slide member 26 in the locking aperture 82 as shown in FIG. 17, thereby locking the telescoping slide system 10 in the PRE-REMOVAL stage.

To move the telescoping slide system 10 from the PRE-REMOVAL stage to the REMOVAL stage, the handle 62 of the right-side locking lever 34 is configured to be engaged with a third downward pivot force F3 as shown in FIGS. 18 and 19. The third downward pivot force F3 is applied to the handle 62 of the right-side locking lever 34 to overcome the bias force applied by the spring 70 to the locking lever 34 while the left-side and right-side telescoping slide assemblies are in the PRE-REMOVAL stage. The third downward pivot force F3 causes the right-side locking lever 34 to pivot between the PRE-REMOVAL-ENGAGED position as shown in FIG. 18 and an INTERMEDIATE-UNRESTRICTED position as shown in FIG. 19.

Once the third downward pivot force F3 has been applied to the right-side locking lever 34 of the toolless release feature 16, the right-side locking lever 34 pivots in a counterclockwise direction to the INTERMEDIATE-UNRESTRICTED position. In the INTERMEDIATE-UNRESTRICTED position, the locker head 64 of the right-side locking lever 34 is spaced apart from the locking aperture 82 so that the telescoping slide system 10 may be moved from the PRE-REMOVAL stage to the REMOVAL stage to separate the piece of equipment 20 from the storage rack 11. The load-carrying slide members 28, 30 of each slide assembly 12, 14 are free to move to the left relative to the corresponding intermediate slide members 24, 26 toward the REMOVAL stage as shown in FIG. 19.

By having to engage the release handle 62 of the right-side locking lever 34 with the third downward pivot force F3, the toolless locking feature 16 prevents accidental removal of the load-carrying slide members 28, 30 from the corresponding slide assemblies 12, 14. Rather, the technician must intentionally engage the release handle 62 of the right-side locking lever 34 to finish removing the piece of equipment 20 from the storage rack 11.

If the release handle 36 of the left-side locking lever 32 was accidently engaged with the second downward pivot force F2, the load-carrying slide members 28, 30 may moved to the right relative to the intermediate slide members 24, 26 from the PRE-REMOVAL stage back to the EXTENDED-SERVICE stage. The telescoping slide system 10 may be moved from the PRE-REMOVAL stage back to the EXTENDED-SERVICE stage without engaging the toolless release feature 16.

In the illustrative embodiment, the locker head 64 of the right-side locking lever 34 further includes a lift ramp 72 as shown in FIG. 18. The lift ramp 72 is configured to pivot the locker head 64 of the right-side locking lever 34 out of the locking aperture 86 formed in the intermediate slide member 26 on the right-side telescoping slide assembly 14 when the telescoping slide system 10 is moved from the PRE-REMOVAL stage back to the EXTENDED-SERVICE stage. The lift ramp 72 allows the telescoping slide system 10 to be moved back to the EXTENDED-SERVICE stage if the left-side locking lever 32 was accidently engaged. Alternatively, the lift ramp 72 also provides for easy return of the piece of equipment 20 back to the storage rack 11. As the load-carrying slide members 28, 30 is re-inserted into the corresponding channels 24C, 26C on the intermediate slide members 24, 26, the lift-ramp 72 pivots the right-side locking lever 34 so that the load-carrying slide members 28, 30 do not get stuck in the PRE-REMOVAL stage.

As the load-carrying slide members 28, 30 move to the right relative to the intermediate slide members 24, 26, the lift-ramp 72 engages an edge 82E of the locking aperture 82. The lift-ram 72 acts as a camming edge to lift and pivot the locker head 64 of the right-side locking lever 34 upwardly away from the intermediate slide member 26 of the right-side telescoping slide assembly 14 to disengage the hook 68 of the locker head 64 from the intermediate slide member 26.

In the illustrative embodiment, the telescoping slide system 10 further includes an intermediate locking and unlocking mechanism 90 as shown in FIGS. 20 and 21. The intermediate locking and unlocking mechanism 90 is coupled to the intermediate slide member 24 of the left-side telescoping slide assembly 12. The intermediate locking and unlocking mechanism 90 is configured to lock the intermediate slide members 24, 26 in a fully extended position relative to the stationary slide members 28, 30.

The intermediate locking and unlocking mechanism 90 includes a latch blade 92 and a biasing spring 94 as shown in FIGS. 20 and 21. The latch blade 92 has a rearward end 100 pivotably mounted on the intermediate slide member 24 of the left-side telescoping slide assembly 12 with a rivet 96 and a forward end 110 arranged to extend through an aperture 118 formed in the intermediate slide member 24 and into an aperture 120 in the stationary slide member 20. The forward end 110 extends through the apertures 118, 120 and engages a lip 120L formed in the stationary slide member 20 of the left-side telescoping slide assembly 12.

The forward end 118 engages the lip 120L to lock the intermediate slide member 24 in a fully extended position relative to the stationary slide member 20 as the telescoping slide system 10 moves from the RETRACTED-STORAGE stage to the EXTENDED-SERVICE stage. The biasing spring 94 is positioned between the intermediate slide member 24 and the intermediate locking and unlocking mechanism 90 to urge the latch blade 92 downwardly into engagement with the lip 120L.

The intermediate locking and unlocking mechanism 90 is configured to change between a LOCKED position as shown in FIG. 20 and an UNLOCKED position as shown in FIG. 21. In the LOCKED position, the forward end 110 extends through the apertures 118, 120 to engage the lip 120L formed in the stationary slide member 20. The forward end 118 engages the lip 120L to lock the intermediate slide member 24. In the UNLOCKED position, a forwardly-facing camming edge 28CE formed on the load-carrying slide member 28 of the left-side telescoping slide assembly 12 engages a forwardly-facing ramping surface 114 formed on the latch blade 92 to lift and pivot the latch blade 92 upwardly away from the stationary slide member 20 of the left-side telescoping slide assembly 12.

In the illustrative embodiment, the forward end 110 is shaped to include a hook 112 as shown in FIGS. 20 and 21. The hook 112 forms a notch 112N in the forward end 100 of the latch blade 92. The notch 112N engages the lip 120L formed in the stationary slide member 20.

The engagement of the forwardly-facing camming edge 28CE with the forwardly-facing ramping surface 114 disengages the notch 112 of the latch blade 92 from the lip 120L in the stationary slide member 20 as shown in FIG. 21. The disengagement of the notch 112 from the lip 120L allows the intermediate slide member 24 of the left-side telescoping slide assembly 12 to move with the load-carrying slide member 28 of the left-side telescoping slide assembly 12 to the right relative to the stationary slide member 20 toward the RETRACTED-STORAGE stage.

In illustrative embodiment, each stationary slide member 20, 22 of the left-side and right-side telescoping slide assemblies 12, 14 is mounted to the storage rack 11 as shown in FIG. 22. Each load-carrying slide member 28, 30 of the left-side and right-side telescoping slide assemblies 12, 14 supports a portion of the equipment 20. Each intermediate slide member 24, 26 of the left-side and right-side telescoping slide assemblies 12, 14 is nested between the stationary and load-carrying slide members 20, 22, 28, 30.

The load-carrying slide members 28, 30 are each supported for sliding movement in the corresponding intermediate slide member 24, 26 by rollers 122, 124 as shown in FIG. 22. The rollers 122, 124 are coupled to the corresponding intermediate slide member 24, 26.

The intermediate slide members 24, 26 are each supported for sliding movement in the corresponding stationary slide members 20, 22 by rollers 126, 128 as shown in FIG. 22. The rollers 126, 128 are attached to the corresponding stationary slide member 20, 22.

In the illustrative embodiment, each stationary slide member 20, 22 includes a bottom portion 130, 132 positioned between two spaced-apart vertical side walls 134A, 134B, 136A, 136B as shown in FIG. 22. The bottom portion 130, 132 is arranged to mount on a fixed platform of the storage rack 11 or another suitable mounting surface. Horizontal flanges 138A, 138B, 140A, 140B extend inwardly from the corresponding vertical side walls 134A, 134B, 136A, 136B to overlie the rollers 126, 128 as shown in FIG. 22.

In the illustrative embodiment, each intermediate slide member 24, 26 includes a bottom portion 142, 144 positioned between two spaced-apart vertical side walls 146A, 146B, 148A, 148B as shown in FIG. 22. Horizontal flanges 150A, 150B, 152A, 152B extend outwardly from the corresponding vertical side walls 146A, 146B, 148A, 148B. The horizontal flanges 150A, 150B, 152A, 152B of the corresponding intermediate slide members 24, 26 are arranged to lie underneath the pair of horizontal flanges 138A, 138B, 140A, 140B of the corresponding stationary slide member 20, 22. The horizontal flanges 150A, 150B, 152A, 152B are supported by rollers 126, 128 mounted on the vertical side walls 134A, 134B, 136A, 136B of the corresponding stationary slide member 20, 22.

In the illustrative embodiment, each load-carrying slide member 28, 30 includes a pair of horizontal load-supporting flanges 154A, 154B, 156A, 156B and central vertical walls 158, 160 as shown in FIG. 22. The horizontal load-supporting flanges 154A, 154B, 156A, 156B extend outwardly in opposite directions from an upper end of the corresponding central vertical walls 158, 160. The piece of equipment 20 to be carried by telescoping slide system 10 is mounted on the load-supporting flanges 154A, 156A of the corresponding load-carrying slide member 28, 30, while the bottom flanges 154B, 156B lie in spaced-apart parallel relation to the upper flanges 154A, 156A. The bottom flanges 154B, 156B extend outwardly in opposite directions from a lower end of the central vertical walls 158, 160. The horizontal load supporting flanges 154A, 156A are supported by the rollers 122, 124 mounted on the vertical side walls 134A, 134B, 136A, 136B of the corresponding intermediate slide member 24, 26.

In the illustrative embodiment, the left-side locking lever 32 is coupled to the vertical side walls 158 of the load-carrying slide member 28 of the left-side telescoping slide assembly 12 as shown in FIG. 22. In the illustrative embodiment, the right-side locking lever 34 is coupled to the vertical side walls 160 of the load-carrying slide member 30 of the right-side telescoping slide assembly 14 as shown in FIG. 22.

A method of extending and retracting the left-side and right-side telescoping slide assemblies 12, 14 among the RETRACTED-STORAGE stage as shown in FIG. 6, the EXTENDED-SERVICE stage as shown in FIG. 7, the PRE-REMOVAL stage as shown in FIG. 8, and the REMOVAL stage as shown in FIG. 9 may include several steps. To move the left-side and right-side telescoping slide assemblies 12, 14 from the RETRACTED-STORAGE stage to the EXTENDED-SERVICE stage, the first downward pivot force F1 is applied to the handle 36 of the left-side locking lever 32. The first downward pivot force F1 is applied to the handle 36 of the left-side locking lever 32 to overcome the bias force applied by the spring 48 to the locking lever 32 while the left-side and right-side telescoping slide assemblies are in the RETRACTED-STORAGE stage. This causes the left-side locking lever 32 to pivot between the STORAGE-ENGAGED position as shown in FIG. 10 and an INTERMEDIATE-RELEASED position as shown in FIG. 11.

With the first downward pivot force F1 applied, i.e. with the left-side locking lever 32 in the INTERMEDIATE-RELEASED position, the left intermediate and load-carrying slide members 24, 28 and the right intermediate and load-carrying slide members 26, 30 are moved relative to the left and right stationary slide members 20, 22 in a first direction from the RETRACTED-STORAGE stage to the EXTENDED-SERVICE stage. Once the left intermediate and load-carrying slide members 24, 28 and the right intermediate and load-carrying slide members 26, 30 being to move, the left-side locking lever 32 may be released. As the left-side and right-side telescoping slide assemblies 12, 14 reach the EXTENDED-SERVICE stage, the left side locking lever 32 extends into the second set of locking apertures 78, 80 formed in the intermediate slide member 24 of the left-side telescoping slide assembly 12 to lock the telescoping slide system in the EXTENDED-SERVICE stage.

To begin removing the piece of equipment 18 from the storage rack 11, the second downward pivot force F2 is applied to the handle 36 of the left-side locking lever 32. The second downward pivot force F2 is applied to the handle 36 of the left-side locking lever 32 to overcome the bias force applied by the spring 48 to the locking lever 32 while the left-side and right-side telescoping slide assemblies are in the EXTENDED-SERVICE stage. This causes the left-side locking lever 32 to pivot between the SERVICE-ENGAGED position as shown in FIG. 14 and the INTERMEDIATE-RELEASED position as shown in FIG. 15.

With the second downward pivot force applied, i.e. with the left-side locking lever 32 in the INTERMEDIATE-RELEASED position, the left and right load-carrying slide members 28, 30 are moved relative to the left stationary and intermediate slide members 20, 24 and the right stationary and intermediate slide members 22, 26 in the first direction from the EXTENDED-SERVICE stage to the PRE-REMOVAL stage. This causes the right-side locking lever 34 to lock the right-side telescoping slide assembly 14 so as to prevent accidental removal of the left and the right load-carrying slide members 28, 30 from the corresponding telescoping slide assemblies 12, 14. Alternatively, the load-carrying slide members 28, 30 may be moved to in a second direction opposite the first direction back toward the RETRACTED-STORAGE stage after the second downward pivot force F2 is applied to the left-side locking lever 32.

To fully remove the piece of equipment 18 from the storage rack 11, the third downward pivot force F3 is applied to the handle 62 of the right-side locking lever 34. The third downward pivot force F3 is applied to the handle 62 of the right-side locking lever 34 to overcome the bias force applied by the spring 70 to the locking lever 34 while the left-side and right-side telescoping slide assemblies are in the PRE-REMOVAL stage. This causes the right-side locking lever 34 to pivot between the PRE-REMOVAL-ENGAGED position as shown in FIG. 18 and an INTERMEDIATE-UNRESTRICTED position as shown in FIG. 19.

With the third downward pivot force F3 applied to the right-side locking lever 34, the left and right load-carrying slide members 28, 30 of left-side and right-side telescoping slide assemblies 14, 16 are moved relative to the left and right stationary slide members 20, 22 and the left and right intermediate slide members 24, 26 in the first direction from the PRE-REMOVAL stage to the REMOVAL stage. The left and right load-carrying slide members 28, 30 are moved in the first direction so that the left and right load-carrying slide members 28, 30 are spaced apart from the left and right stationary slide members 20, 22 and the left and right intermediate slide members 24, 26.

The following numbered clauses include embodiments that are contemplated and non-limiting:

Clause 1. A telescoping slide system comprising a left-side telescoping slide assembly including interconnected slide members moveable to extend and retract among a retracted-storage stage, an extended-service stage, a pre-removal stage, and a removal stage and a right-side telescoping slide assembly including interconnected, slide members moveable to extend and retract with the left-side telescoping slide assembly among the retracted-storage stage, the extended-service stage, the pre-removal stage, and the removal stage.

Clause 2. The telescoping slide system of clause 1, any other suitable clause, or combination of clauses, wherein the slide members of the a left-side telescoping slide assembly include a left stationary slide member, a left intermediate slide member that moves relative to the left stationary slide member in a channel formed in the left stationary slide member, and a left load-carrying slide member that moves relative to the left stationary slide member and the left intermediate slide member in a channel formed in the left intermediate slide member, and the slide members of the right-side telescoping slide assembly include a right stationary slide member, a right intermediate slide member that moves relative to the right stationary slide member in a channel formed in the right stationary slide member, and a right load-carrying slide member that moves relative to the right stationary slide member and the right intermediate slide member in a channel formed in the right intermediate slide member.

Clause 3. The telescoping slide system of clause 2, any other suitable clause, or combination of clauses, further comprising a toolless release feature.

Clause 4. The telescoping slide system of clause 3, any other suitable clause, or combination of clauses, wherein the toolless release feature comprises a left-side lever means for releasing the left load-carrying slide member and the left intermediate slide member for movement relative to the left stationary slide member to allow the left-side and right-side telescoping slide assemblies to change from the retracted-storage stage to the extended-service stage in response to a first downward pivot force, and for releasing the left load-carrying slide member for movement relative to the left intermediate slide member to allow the left-side and right-side telescoping slide assemblies to change from the extended-service stage to one of the retracted-storage stage and the pre-removal stage in response to a second downward pivot force.

Clause 5. The telescoping slide system of clause 4, any other suitable clause, or combination of clauses, wherein the toolless release feature further comprises a right-side lever means for locking the right load-carrying slide member to the right intermediate carrier slide member in response to the left and right load-carrying slide members moving from the extended-service stage to the pre-removal stage to prevent the right and left load-carrying slide members from moving relative to the right and left intermediate slide members so as to prevent accidental removal of the left and the right load-carrying slide members from the corresponding telescoping slide assemblies, and for releasing the right load-carrying slide member for relative movement to the right intermediate slide member to allow the left-side and right-side telescoping slide assemblies to change between the pre-removal stage and the removal stage in response to a third downward pivot force so that the left and right load-carrying slide members are spaced apart from the left and right intermediate and stationary slide members.

Clause 6. The telescoping slide system of clause 5, any other suitable clause, or combination of clauses, wherein the left-side lever means includes a left-side locking lever pivotably coupled to the left load-carrying slide member of the left-side telescoping slide assembly and the left-side locking lever is configured to change between (i) a storage-engaged position when the left-side and right-side telescoping slide assemblies are in the retracted-storage stage so that the left load-carrying and intermediate slide members are blocked from movement relative to the left stationary slide member in the retracted-storage stage and (ii) a service-engaged position when the left-side and right-side telescoping slide assemblies are in the extended-service stage so that the left load-carrying slide member is blocked from movement relative to the left intermediate and stationary slide members in the extended-service stage.

Clause 7. The telescoping slide system of clause 6, any other suitable clause, or combination of clauses, wherein the left-side locking lever includes a locker head configured to engage the left stationary slide member of the left-side telescoping slide assembly in the retracted-storage stage to prevent movement of the left load-carrying and intermediate slide members relative to the left stationary slide member and to engage the left intermediate slide member of the left-side telescoping slide assembly in the extended-service stage to prevent movement of the left load-carrying slide member relative to the left intermediate slide member and a release handle that extends form the locker head and configured to pivot the left-side locking lever and move the locker head away from one of the left stationary slide member and the left intermediate slide member when one of the first downward pivot force and the second downward pivot force is applied to the release handle to allow the left-side and the right-side telescoping slide assemblies to change between the retracted-storage stage and the extended-service stage.

Clause 8. The telescoping slide system of clause 7, any other suitable clause, or combination of clauses, wherein the left-side locking lever is positioned relative to the left load-carrying slide member so that a distal end portion of the release handle extends beyond a distal end of the left load-carrying slide member.

Clause 9. The telescoping slide system of clause 7, any other suitable clause, or combination of clauses, wherein the locker head of the left-side locking lever extends into a first set of locking apertures formed in the left stationary and intermediate slide members of the left-side telescoping slide assembly when the left-side and the right-side telescoping slide assemblies are in the retracted-storage stage, wherein the locker head of the left-side locking lever extends into a second set of locking apertures formed in the left intermediate slide member of the left-side telescoping slide assembly when the left-side and the right-side telescoping slide assemblies are in the extended-service stage, and wherein the second set of locking apertures are spaced apart from the first set of locking apertures along the left-side telescoping slide assembly.

Clause 10. The telescoping slide system of clause 9, any other suitable clause, or combination of clauses, wherein the locker head is shaped to include locking lugs that extend into the first set of locking apertures in the left stationary and intermediate slide members when the left-side and the right-side telescoping slide assemblies are in the retracted-storage stage and extend into the second set of locking apertures in the left intermediate slide member when the left-side and the right-side telescoping slide assemblies are in the extended-service stage.

Clause 11. The telescoping slide system of clause 6, any other suitable clause, or combination of clauses, wherein the right-side lever means includes a right-side locking lever pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage so that the right load-carrying and intermediate slide members are free for movement relative to the right stationary slide member to allow the left-side and right-side telescoping slide assemblies change between the retracted-storage stage and the extended-service stage and (ii) a pre-removal-engaged position when the left-side and right-side telescoping slide assemblies are in the pre-removal stage so that the right load-carrying slide member is partially blocked from movement relative to the right intermediate and stationary slide members in the pre-removal stage to prevent accidental removal of the equipment from the storage rack.

Clause 12. The telescoping slide system of clause 5, any other suitable clause, or combination of clauses, wherein the right-side lever means includes a right-side locking lever pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage so that the right load-carrying and intermediate slide members are free for movement relative to the right stationary slide member to allow the left-side and right-side telescoping slide assemblies change between the retracted-storage stage and the extended-service stage and (ii) a pre-removal-engaged position when the left-side and right-side telescoping slide assemblies are in the pre-removal stage so that the right load-carrying slide member is partially blocked from movement relative to the right intermediate and stationary slide members in the pre-removal stage to prevent accidental removal of the equipment from the storage rack.

Clause 13. The telescoping slide system of clause 12, any other suitable clause, or combination of clauses, wherein the right-side locking lever includes a locker head configured to engage the right intermediate slide member of the right-side telescoping slide assembly in the pre-removal stage to prevent movement of the right load-carrying slide member relative to the right intermediate slide member and a release handle that extends form the locker head and configured to pivot the right-side locking lever and move the locker head away from one of the right intermediate slide member when one of the third downward pivot force is applied to the release handle to allow the left-side and the right-side telescoping slide assemblies to change between the pre-removal stage and the removal stage.

Clause 14. The telescoping slide system of clause 13, any other suitable clause, or combination of clauses, wherein the right-side locking lever is positioned relative to the right load-carrying slide member so that a distal end of the right load-carrying slide member extends beyond a distal end portion of the release handle.

Clause 15. The telescoping slide system of clause 13, any other suitable clause, or combination of clauses, wherein the locker head of the right-side locking lever extends into a locking aperture formed in the right intermediate slide member of the right-side telescoping slide assembly when the left-side and the right-side telescoping slide assemblies are in the pre-removal stage.

Clause 16. The telescoping slide system of clause 5, any other suitable clause, or combination of clauses, wherein the left-side lever means includes a left-side locking lever pivotably coupled to the left load-carrying slide member of the left-side telescoping slide assembly and the left-side locking lever is configured to change between (i) a storage-engaged position when the left-side and right-side telescoping slide assemblies are in the retracted-storage stage and (ii)

a service-engaged position when the left-side and right-side telescoping slide assemblies are in the extended-service stage, wherein the right-side lever means includes a right-side locking lever pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage (ii) a pre-removal-engaged position when the left-side and right-side telescoping slide assemblies are in the pre-removal stage.

Clause 17. The telescoping slide system of clause 16, any other suitable clause, or combination of clauses, wherein the left-side locking lever and the right-side locking lever each include a spring configured to apply a bias force to the corresponding locking lever and the first, second, and third downward pivot forces overcome the bias force applied by the spring of the corresponding locking lever.

Clause 18. The telescoping slide system of clause 17, any other suitable clause, or combination of clauses, wherein the first downward pivot force and the second downward pivot force are equal.

Clause 19. The telescoping slide system of clause 17, any other suitable clause, or combination of clauses, wherein the left-side locking lever further includes a locker head configured to engage the left stationary slide member of the left-side telescoping slide assembly in the retracted-storage stage to prevent movement of the left load-carrying and intermediate slide members relative to the left stationary slide member and to engage the left intermediate slide member of the left-side telescoping slide assembly in the extended-service stage to prevent movement of the left load-carrying slide member relative to the left intermediate slide member and a release handle that extends form the locker head and configured to pivot the left-side locking lever and move the locker head away from one of the left stationary slide member and the left intermediate slide member when one of the first downward pivot force and the second downward pivot force is applied to the release handle to allow the left-side and the right-side telescoping slide assemblies to change between the retracted-storage stage and the extended-service stage.

Clause 20. The telescoping slide system of clause 19, any other suitable clause, or combination of clauses, wherein the right-side locking lever further includes a locker head configured to engage the right intermediate slide member of the right-side telescoping slide assembly in the pre-removal stage to prevent movement of the right load-carrying slide member relative to the right intermediate slide member and a release handle that extends form the locker head and configured to pivot the right-side locking lever and move the locker head away from one of the right intermediate slide member when one of the third downward pivot force is applied to the release handle to allow the left-side and the right-side telescoping slide assemblies to change between the pre-removal stage and the removal stage.

Clause 21. A telescoping slide system comprising a left-side telescoping slide assembly including interconnected slide members moveable to extend and retract among a retracted-storage stage, an extended-service stage, a pre-removal stage, and a removal stage, the slide members including a left stationary slide member, a left intermediate slide member that moves relative to the left stationary slide member in a channel formed in the left stationary slide member, and a left load-carrying slide member that moves relative to the left stationary slide member and the left intermediate slide member in a channel formed in the left intermediate slide member, a right-side telescoping slide assembly including interconnected, slide members moveable to extend and retract with the left-side telescoping slide assembly among the retracted-storage stage, the extended-service stage, the pre-removal stage, and the removal stage, the slide members including a right stationary slide member, a right intermediate slide member that moves relative to the right stationary slide member in a channel formed in the right stationary slide member, and a right load-carrying slide member that moves relative to the right stationary slide member and the right intermediate slide member in a channel formed in the right intermediate slide member, and a toolless release feature.

Clause 22. The telescoping slide system of clause 21, any other suitable clause, or combination of clauses, wherein the toolless release feature comprises a left-side locking lever configured to release the left load-carrying slide member and the left intermediate slide member for movement relative to the left stationary slide member to allow the left-side and right-side telescoping slide assemblies to change from the retracted-storage stage to the extended-service stage in response to a first downward pivot force and configured to release the left load-carrying slide member for movement relative to the left intermediate slide member to allow the left-side and right-side telescoping slide assemblies to change from the extended-service stage to one of the retracted-storage stage and the pre-removal stage in response to a second downward pivot force, and a right-side locking lever configured to lock the right load-carrying slide member to the right intermediate carrier slide member in response to the left and right load-carrying slide members moving from the extended-service stage to the pre-removal stage to prevent the right and left load-carrying slide members from moving relative to the right and left intermediate slide members so as to prevent accidental removal of the left and the right load-carrying slide members from the corresponding telescoping slide assemblies and configured to release the right load-carrying slide member for relative movement to the right intermediate slide member to allow the left-side and right-side telescoping slide assemblies to change between the pre-removal stage and the removal stage in response to a third downward pivot force so that the left and right load-carrying slide members are spaced apart from the left and right intermediate and stationary slide members.

Clause 23. The telescoping slide system of clause 22, any other suitable clause, or combination of clauses, wherein the left-side locking lever is pivotably coupled to the left load-carrying slide member of the left-side telescoping slide assembly and the left-side locking lever is configured to change between (i) a storage-engaged position when the left-side and right-side telescoping slide assemblies are in the retracted-storage stage and (ii) a service-engaged position when the left-side and right-side telescoping slide assemblies are in the extended-service stage, Clause 24. The telescoping slide system of clause 23, any other suitable clause, or combination of clauses, wherein the right-side locking lever is pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage (ii) a pre-removal-engaged position when the left-side and right-side telescoping slide assemblies are in the pre-removal stage.

Clause 25. The telescoping slide system of clause 24, any other suitable clause, or combination of clauses, wherein the left-side locking lever includes a locker head configured to engage the left stationary slide member of the left-side telescoping slide assembly in the retracted-storage stage to prevent movement of the left load-carrying and intermediate slide members relative to the left stationary slide member and to engage the left intermediate slide member of the left-side telescoping slide assembly in the extended-service stage to prevent movement of the left load-carrying slide member relative to the left intermediate slide member and a release handle that extends form the locker head and configured to pivot the left-side locking lever and move the locker head away from one of the left stationary slide member and the left intermediate slide member when one of the first downward pivot force and the second downward pivot force is applied to the release handle to allow the left-side and the right-side telescoping slide assemblies to change between the retracted-storage stage and the extended-service stage.

Clause 26. The telescoping slide system of clause 25, any other suitable clause, or combination of clauses, wherein the locker head of the left-side locking lever extends into a first set of locking apertures formed in the left stationary and intermediate slide members of the left-side telescoping slide assembly when the left-side and the right-side telescoping slide assemblies are in the retracted-storage stage, wherein the locker head of the left-side locking lever extends into a second set of locking apertures formed in the left intermediate slide member of the left-side telescoping slide assembly when the left-side and the right-side telescoping slide assemblies are in the extended-service stage, and wherein the second set of locking apertures are spaced apart from the first set of locking apertures along the left-side telescoping slide assembly.

Clause 27. The telescoping slide system of clause 25, any other suitable clause, or combination of clauses, wherein the locker head is shaped to include locking lugs that extend into a first set of locking apertures formed in the left stationary and intermediate slide members of the left-side telescoping slide assembly when the left-side and the right-side telescoping slide assemblies are in the retracted-storage stage and extend into a second set of locking apertures formed in the left intermediate slide member of the left-side telescoping slide assembly when the left-side and the right-side telescoping slide assemblies are in the extended-service stage.

Clause 28. The telescoping slide system of clause 24, any other suitable clause, or combination of clauses, wherein the right-side locking lever includes a locker head configured to engage the right intermediate slide member of the right-side telescoping slide assembly in the pre-removal stage to prevent movement of the right load-carrying slide member relative to the right intermediate slide member and a release handle that extends form the locker head and configured to pivot the right-side locking lever and move the locker head away from one of the right intermediate slide member when one of the third downward pivot force is applied to the release handle to allow the left-side and the right-side telescoping slide assemblies to change between the pre-removal stage and the removal stage.

Clause 29. The telescoping slide system of clause 28, any other suitable clause, or combination of clauses, wherein the locker head of the right-side locking lever extends into a locking aperture formed in the right intermediate slide member of the right-side telescoping slide assembly when the left-side and the right-side telescoping slide assemblies are in the pre-removal stage.

Clause 30. The telescoping slide system of clause 22, any other suitable clause, or combination of clauses, wherein the left-side locking lever and the right-side locking lever each include a spring configured to apply a bias force to the corresponding locking lever and the first, second, and third downward pivot forces overcome the bias force applied by the spring of the corresponding locking lever.

Clause 31. The telescoping slide system of clause 22, any other suitable clause, or combination of clauses, wherein the left-side locking lever is positioned relative to the left load-carrying slide member so that a distal end portion of the left-side locking lever extends beyond a distal end of the left load-carrying slide member.

Clause 32. The telescoping slide system of clause 22, any other suitable clause, or combination of clauses, wherein the right-side locking lever is positioned relative to the right load-carrying slide member so that a distal end of the right load-carrying slide member extends beyond a distal end portion of the right-side locking lever.

Clause 33. The telescoping slide system of clause 24, any other suitable clause, or combination of clauses, wherein the first downward pivot force and the second downward pivot force are equal.

Clause 34. A method comprising providing a telescoping slide system, the telescoping slide system comprising a left-side telescoping slide assembly including interconnected slide members moveable to extend and retract among a retracted-storage stage, an extended-service stage, a pre-removal stage, and a removal stage, the slide members including a left stationary slide member, a left intermediate slide member that moves relative to the left stationary slide member in a channel formed in the left stationary slide member, and a left load-carrying slide member that moves relative to the left stationary slide member and the left intermediate slide member in a channel formed in the left intermediate slide member, a right-side telescoping slide assembly including interconnected, slide members moveable to extend and retract with the left-side telescoping slide assembly among the retracted-storage stage, the extended-service stage, the pre-removal stage, and the removal stage, the slide members including a right stationary slide member, a right intermediate slide member that moves relative to the right stationary slide member in a channel formed in the right stationary slide member, and a right load-carrying slide member that moves relative to the right stationary slide member and the right intermediate slide member in a channel formed in the right intermediate slide member, and a toolless release feature comprising a left-side locking lever coupled to the left load-carrying slide member of the left-side telescoping slide assembly and a right-side locking lever coupled to the right load-carrying slide member of the right-side telescoping slide assembly.

Clause 35. The method of clause 34, any other suitable clause, or combination of clauses, further comprising applying a first downward pivot force to the left-side locking lever to cause the left-side locking lever to pivot relative to the left-side telescoping slide assembly when the left-side and right-side telescoping slide assemblies are in the retracted-storage stage.

Clause 36. The method of clause 35, any other suitable clause, or combination of clauses, further comprising moving the left intermediate slide member, the left load-carrying slide member, the right intermediate slide member, and the right load-carrying slide member of left-side and right-side telescoping slide assemblies relative to the left and right stationary slide members in a first direction from the retracted-storage stage to the extended-service stage after applying the first downward pivot force to the left-side locking lever.

Clause 37. The method of clause 36, any other suitable clause, or combination of clauses, further comprising applying a second downward pivot force to the left-side locking lever to cause the left-side locking lever to pivot relative to the left-side telescoping slide assembly once the left-side and right-side telescoping slide assemblies are in the extended-service stage.

Clause 38. The method of clause 37, any other suitable clause, or combination of clauses, further comprising moving the left load-carrying slide member and the right load-carrying slide member of left-side and right-side telescoping slide assemblies relative to the left and right stationary slide members and the left and right intermediate slide members in the first direction from the extended-service stage to the pre-removal stage after applying the second downward pivot force to the left-side locking lever to cause the right-side locking lever to lock the right-side telescoping slide assembly so as to prevent accidental removal of the left and the right load-carrying slide members from the corresponding telescoping slide assemblies.

Clause 39. The method of clause 38, any other suitable clause, or combination of clauses, further comprising applying a third downward pivot force to the right-side locking lever to cause the right-side locking lever to pivot relative to the right-side telescoping slide assembly once the left-side and right-side telescoping slide assemblies are in the pre-removal stage.

Clause 40. The method of clause 39, any other suitable clause, or combination of clauses, further comprising moving the left load-carrying slide member and the right load-carrying slide member of left-side and right-side telescoping slide assemblies relative to the left and right stationary slide members and the left and right intermediate slide members in the first direction from the pre-removal stage to the removal stage after applying the third downward pivot force to the right-side locking lever so that the left load-carrying slide member and the right load-carrying slide member are spaced apart from the left and right stationary slide members and the left and right intermediate slide members.

Clause 41. The method of clause 40, any other suitable clause, or combination of clauses, wherein the left-side locking lever includes a locker head configured to engage the left stationary slide member of the left-side telescoping slide assembly in the retracted-storage stage to prevent movement of the left load-carrying and intermediate slide members relative to the left stationary slide member and to engage the left intermediate slide member of the left-side telescoping slide assembly in the extended-service stage to prevent movement of the left load-carrying slide member relative to the left intermediate slide member and a release handle that extends form the locker head and configured to pivot the left-side locking lever and move the locker head away from one of the left stationary slide member and the left intermediate slide member when one of the first downward pivot force and the second downward pivot force is applied to the release handle to allow the left-side and the right-side telescoping slide assemblies to change between the retracted-storage stage and the extended-service stage.

Clause 42. The method of clause 41, any other suitable clause, or combination of clauses, wherein the locker head of the left-side locking lever extends into a first set of locking apertures formed in the left stationary and intermediate slide members of the left-side telescoping slide assembly when the left-side and the right-side telescoping slide assemblies are in the retracted-storage stage, wherein the locker head of the left-side locking lever extends into a second set of locking apertures formed in the left intermediate slide member of the left-side telescoping slide assembly when the left-side and the right-side telescoping slide assemblies are in the extended-service stage, and wherein the second set of locking apertures are spaced apart from the first set of locking apertures along the left-side telescoping slide assembly.

Clause 43. The method of clause 42, any other suitable clause, or combination of clauses, wherein the locker head is shaped to include locking lugs that extend into a first set of locking apertures formed in the left stationary and intermediate slide members of the left-side telescoping slide assembly when the left-side and the right-side telescoping slide assemblies are in the retracted-storage stage and extend into a second set of locking apertures formed in the left intermediate slide member of the left-side telescoping slide assembly when the left-side and the right-side telescoping slide assemblies are in the extended-service stage.

Clause 44. The method of clause 40, any other suitable clause, or combination of clauses, wherein the right-side locking lever includes a locker head configured to engage the right intermediate slide member of the right-side telescoping slide assembly in the pre-removal stage to prevent movement of the right load-carrying slide member relative to the right intermediate slide member and a release handle that extends form the locker head and configured to pivot the right-side locking lever and move the locker head away from one of the right intermediate slide member when one of the third downward pivot force is applied to the release handle to allow the left-side and the right-side telescoping slide assemblies to change between the pre-removal stage and the removal stage.

Clause 45. The method of clause 44, any other suitable clause, or combination of clauses, wherein the locker head of the right-side locking lever extends into a locking aperture formed in the right intermediate slide member of the right-side telescoping slide assembly when the left-side and the right-side telescoping slide assemblies are in the pre-removal stage.

Clause 49. The method of clause 40, any other suitable clause, or combination of clauses, wherein the left-side locking lever and the right-side locking lever each include a spring configured to apply a bias force to the corresponding locking lever and the first, second, and third downward pivot forces overcome the bias force applied by the spring of the corresponding locking lever.

Clause 50. The method of clause 49, any other suitable clause, or combination of clauses, wherein the first downward pivot force and the second downward pivot force are equal.

Clause 51. The method of clause 40, any other suitable clause, or combination of clauses, wherein the left-side locking lever is positioned relative to the left load-carrying slide member so that a distal end portion of the left-side locking lever extends beyond a distal end of the left load-carrying slide member.

Clause 52. The method of clause 40, any other suitable clause, or combination of clauses, wherein the right-side locking lever is positioned relative to the right load-carrying slide member so that a distal end of the right load-carrying slide member extends beyond a distal end portion of the right-side locking lever.

The invention claimed is:

1. A telescoping slide system comprising:

a left-side telescoping slide assembly including interconnected slide members moveable to extend and retract among a retracted-storage stage, an extended-service stage, a pre-removal stage, and a removal stage, the slide members including a left stationary slide member, a left intermediate slide member that moves relative to the left stationary slide member in a channel formed in the left stationary slide member, and a left load-carrying slide member that moves relative to the left stationary slide member and the left intermediate slide member in a channel formed in the left intermediate slide member, a right-side telescoping slide assembly including interconnected slide members moveable to extend and retract with the left-side telescoping slide assembly among the retracted-storage stage, the extended-service stage, the pre-removal stage, and the removal stage, the slide members including a right stationary slide member, a right intermediate slide member that moves relative to the right stationary slide member in a channel formed in the right stationary slide member, and a right load-carrying slide member that moves relative to the right stationary slide member and the right intermediate slide member in a channel formed in the right intermediate slide member, and a toolless release feature comprising:

a left-side lever means for releasing the left load-carrying slide member and the left intermediate slide member for movement relative to the left stationary slide member to allow the left-side and right-side telescoping slide assemblies to change from the retracted-storage stage to the extended-service stage in response to a first downward pivot force, and for releasing the left load-carrying slide member for movement relative to the left intermediate slide member to allow the left-side and right-side telescoping slide assemblies to change from the extended-service stage to one of the retracted-storage stage and the pre-removal stage in response to a second downward pivot force, and a right-side lever means for locking the right load-carrying slide member to the right intermediate carrier slide member in response to the left and right load-carrying slide members moving from the extended-service stage to the pre-removal stage to prevent the right and left load-carrying slide members from moving relative to the right and left intermediate slide members so as to prevent accidental removal of the left and the right load-carrying slide members from the corresponding telescoping slide assemblies, and for releasing the right load-carrying slide member for relative movement to the right intermediate slide member to allow the left-side and right-side telescoping slide assemblies to change between the pre-removal stage and the removal stage in response to a third downward pivot force so that the left and right load-carrying slide members are spaced apart from the left and right intermediate and stationary slide members.

2. The telescoping slide system of claim 1, wherein the left-side lever means includes a left-side locking lever pivotably coupled to the left load-carrying slide member of the left-side telescoping slide assembly and the left-side locking lever is configured to change between (i) a storage-engaged position when the left-side and right-side telescoping slide assemblies are in the retracted-storage stage so that the left load-carrying and intermediate slide members are blocked from movement relative to the left stationary slide member in the retracted-storage stage and (ii) a service-engaged position when the left-side and right-side telescoping slide assemblies are in the extended-service stage so that the left load-carrying slide member is blocked from movement relative to the left intermediate and stationary slide members in the extended-service stage.

3. The telescoping slide system of claim 2, wherein the left-side locking lever includes a locker head configured to engage the left stationary slide member of the left-side telescoping slide assembly in the retracted-storage stage to prevent movement of the left load-carrying and intermediate slide members relative to the left stationary slide member and to engage the left intermediate slide member of the left-side telescoping slide assembly in the extended-service stage to prevent movement of the left load-carrying slide member relative to the left intermediate slide member and a release handle that extends form the locker head and configured to pivot the left-side locking lever and move the locker head away from one of the left stationary slide member and the left intermediate slide member when one of the first downward pivot force and the second downward pivot force is applied to the release handle to allow the left-side and the right-side telescoping slide assemblies to change between the retracted-storage stage and the extended-service stage.

4. The telescoping slide system of claim 3, wherein the left-side locking lever is positioned relative to the left load-carrying slide member so that a distal end portion of the release handle extends beyond a distal end of the left load-carrying slide member.

5. The telescoping slide system of claim 3, wherein the locker head of the left-side locking lever extends into a first set of locking apertures formed in the left stationary and intermediate slide members of the left-side telescoping slide assembly when the left-side and the right-side telescoping slide assemblies are in the retracted-storage stage, wherein the locker head of the left-side locking lever extends into a second set of locking apertures formed in the left intermediate slide member of the left-side telescoping slide assembly when the left-side and the right-side telescoping slide assemblies are in the extended-service stage, and wherein the second set of locking apertures are spaced apart from the first set of locking apertures along the left-side telescoping slide assembly.

6. The telescoping slide system of claim 5, wherein the locker head is shaped to include locking lugs that extend into the first set of locking apertures in the left stationary and intermediate slide members when the left-side and the right-side telescoping slide assemblies are in the retracted-storage stage and extend into the second set of locking apertures in the left intermediate slide member when the left-side and the right-side telescoping slide assemblies are in the extended-service stage.

7. The telescoping slide system of claim 2, wherein the right-side lever means includes a right-side locking lever pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage so that the right load-carrying and intermediate slide members are free for movement relative to the right stationary slide member to allow the left-side and right-side telescoping slide assemblies change between the retracted-storage stage and the extended-service stage and (ii) a pre-removal-engaged position when the left-side and right-side telescoping slide assemblies are in the pre-removal stage so that the right load-carrying slide member is partially blocked from movement relative to the right intermediate and stationary slide members in the pre-removal stage to prevent accidental removal of the equipment from the storage rack.

8. The telescoping slide system of claim 1, wherein the right-side lever means includes a right-side locking lever pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage so that the right load-carrying and intermediate slide members are free for movement relative to the right stationary slide member to allow the left-side and right-side telescoping slide assemblies change between the retracted-storage stage and the extended-service stage and (ii) a pre-removal-engaged position when the left-side and right-side telescoping slide assemblies are in the pre-removal stage so that the right load-carrying slide member is partially blocked from movement relative to the right intermediate and stationary slide members in the pre-removal stage to prevent accidental removal of the equipment from the storage rack.

9. The telescoping slide system of claim 8, wherein the right-side locking lever includes a locker head configured to engage the right intermediate slide member of the right-side telescoping slide assembly in the pre-removal stage to prevent movement of the right load-carrying slide member relative to the right intermediate slide member and a release handle that extends form the locker head and configured to pivot the right-side locking lever and move the locker head away from one of the right intermediate slide member when one of the third downward pivot force is applied to the release handle to allow the left-side and the right-side telescoping slide assemblies to change between the pre-removal stage and the removal stage.

10. The telescoping slide system of claim 9, wherein the right-side locking lever is positioned relative to the right load-carrying slide member so that a distal end of the right load-carrying slide member extends beyond a distal end portion of the release handle.

11. The telescoping slide system of claim 9, wherein the locker head of the right-side locking lever extends into a locking aperture formed in the right intermediate slide member of the right-side telescoping slide assembly when the left-side and the right-side telescoping slide assemblies are in the pre-removal stage.

12. The telescoping slide system of claim 1, wherein the left-side lever means includes a left-side locking lever pivotably coupled to the left load-carrying slide member of the left-side telescoping slide assembly and the left-side locking lever is configured to change between (i) a storage-engaged position when the left-side and right-side telescoping slide assemblies are in the retracted-storage stage and (ii) a service-engaged position when the left-side and right-side telescoping slide assemblies are in the extended-service stage, wherein the right-side lever means includes a right-side locking lever pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage (ii) a pre-removal-engaged position when the left-side and right-side telescoping slide assemblies are in the pre-removal stage, and wherein the left-side locking lever and the right-side locking lever each include a spring configured to apply a bias force to the corresponding locking lever and the first, second, and third downward pivot forces overcome the bias force applied by the spring of the corresponding locking lever.

13. The telescoping slide system of claim 12, wherein the left-side locking lever further includes a locker head configured to engage the left stationary slide member of the left-side telescoping slide assembly in the retracted-storage stage to prevent movement of the left load-carrying and intermediate slide members relative to the left stationary slide member and to engage the left intermediate slide member of the left-side telescoping slide assembly in the extended-service stage to prevent movement of the left load-carrying slide member relative to the left intermediate slide member and a release handle that extends form the locker head and configured to pivot the left-side locking lever and move the locker head away from one of the left stationary slide member and the left intermediate slide member when one of the first downward pivot force and the second downward pivot force is applied to the release handle to allow the left-side and the right-side telescoping slide assemblies to change between the retracted-storage stage and the extended-service stage.

14. The telescoping slide system of claim 13, wherein the right-side locking lever further includes a locker head configured to engage the right intermediate slide member of the right-side telescoping slide assembly in the pre-removal stage to prevent movement of the right load-carrying slide member relative to the right intermediate slide member and a release handle that extends form the locker head and configured to pivot the right-side locking lever and move the locker head away from one of the right intermediate slide member when one of the third downward pivot force is applied to the release handle to allow the left-side and the right-side telescoping slide assemblies to change between the pre-removal stage and the removal stage.

15. A telescoping slide system comprising:

a left-side telescoping slide assembly including interconnected slide members moveable to extend and retract among a retracted-storage stage, an extended-service stage, a pre-removal stage, and a removal stage, the slide members including a left stationary slide member, a left intermediate slide member that moves relative to the left stationary slide member in a channel formed in the left stationary slide member, and a left load-carrying slide member that moves relative to the left stationary slide member and the left intermediate slide member in a channel formed in the left intermediate slide member, a right-side telescoping slide assembly including interconnected slide members moveable to extend and retract with the left-side telescoping slide assembly among the retracted-storage stage, the extended-service stage, the pre-removal stage, and the removal stage, the slide members including a right stationary slide member, a right intermediate slide member that moves relative to the right stationary slide member in a channel formed in the right stationary slide member, and a right load-carrying slide member that moves relative to the right stationary slide member and the right intermediate slide member in a channel formed in the right intermediate slide member, and a toolless release feature comprising a left-side locking lever configured to release the left load-carrying slide member and the left intermediate slide member for movement relative to the left stationary slide member to allow the left-side and right-side telescoping slide assemblies to change from the retracted-storage stage to the extended-service stage in response to a first downward pivot force and configured to release the left load-carrying slide member for movement relative to the left intermediate slide member to allow the left-side and right-side telescoping slide assemblies to change from the extended-service stage to one of the retracted-storage stage and the pre-removal stage in response to a second downward pivot force, and a right-side locking lever configured to lock the right load-carrying slide member to the right intermediate carrier slide member in response to the left and right load-carrying slide members moving from the extended-service stage to the pre-removal stage to prevent the right and left load-carrying slide members from moving relative to the right and left intermediate slide members so as to prevent accidental removal of the left and the right load-carrying slide members from the corresponding telescoping slide assemblies and configured to release the right load-carrying slide member for relative movement to the right intermediate slide member to allow the left-side and right-side telescoping slide assemblies to change between the pre-removal stage and the removal stage in response to a third downward pivot force so that the left and right load-carrying slide members are spaced apart from the left and right intermediate and stationary slide members.

16. The telescoping slide system of claim 15, wherein the left-side locking lever is pivotably coupled to the left load-carrying slide member of the left-side telescoping slide assembly and the left-side locking lever is configured to change between (i) a storage-engaged position when the left-side and right-side telescoping slide assemblies are in the retracted-storage stage and (ii) a service-engaged position when the left-side and right-side telescoping slide assemblies are in the extended-service stage, and wherein the right-side locking lever is pivotably coupled to the right load-carrying slide member of the right-side telescoping slide assembly and the right-side locking lever is configured to change between (i) a storage-unrestricted position when the left-side and right-side telescoping slide assemblies are in the retracted-storage stage and the extended-service stage (ii) a pre-removal-engaged position when the left-side and right-side telescoping slide assemblies are in the pre-removal stage.

17. The telescoping slide system of claim 16, wherein the left-side locking lever includes a locker head configured to engage the left stationary slide member of the left-side telescoping slide assembly in the retracted-storage stage to prevent movement of the left load-carrying and intermediate slide members relative to the left stationary slide member and to engage the left intermediate slide member of the left-side telescoping slide assembly in the extended-service stage to prevent movement of the left load-carrying slide member relative to the left intermediate slide member and a release handle that extends form the locker head and configured to pivot the left-side locking lever and move the locker head away from one of the left stationary slide member and the left intermediate slide member when one of the first downward pivot force and the second downward pivot force is applied to the release handle to allow the left-side and the right-side telescoping slide assemblies to change between the retracted-storage stage and the extended-service stage.

18. The telescoping slide system of claim 16, wherein the right-side locking lever includes a locker head configured to engage the right intermediate slide member of the right-side telescoping slide assembly in the pre-removal stage to prevent movement of the right load-carrying slide member relative to the right intermediate slide member and a release handle that extends form the locker head and configured to pivot the right-side locking lever and move the locker head away from one of the right intermediate slide member when one of the third downward pivot force is applied to the release handle to allow the left-side and the right-side telescoping slide assemblies to change between the pre-removal stage and the removal stage.

19. The telescoping slide system of claim 15, wherein the left-side locking lever is positioned relative to the left load-carrying slide member so that a distal end portion of the left-side locking lever extends beyond a distal end of the left load-carrying slide member.

20. The telescoping slide system of claim 15, wherein the right-side locking lever is positioned relative to the right load-carrying slide member so that a distal end of the right load-carrying slide member extends beyond a distal end portion of the right-side locking lever.

* * * * *